US006695971B2

(12) United States Patent
Murakami et al.

(10) Patent No.: US 6,695,971 B2
(45) Date of Patent: Feb. 24, 2004

(54) SPINNING OIL FOR SYNTHETIC FIBER

(75) Inventors: Satoru Murakami, Kyoto (JP); Hideo Hironaga, Kyoto (JP)

(73) Assignee: Sanyo Chemical Industries, Ltd., Kyoto (JP)

( * ) Notice: Subject to any disclaimer, the term of this patent is extended or adjusted under 35 U.S.C. 154(b) by 273 days.

(21) Appl. No.: 09/914,157

(22) PCT Filed: Dec. 28, 2000

(86) PCT No.: PCT/JP00/09395

§ 371 (c)(1),
(2), (4) Date: Oct. 4, 2001

(87) PCT Pub. No.: WO01/48301

PCT Pub. Date: Jul. 5, 2001

(65) Prior Publication Data

US 2003/0050722 A1 Mar. 13, 2003

(30) Foreign Application Priority Data

Dec. 28, 1999 (JP) ..... 11-374182
Apr. 5, 2000 (JP) ..... 2000-104049

(51) Int. Cl.[7] ..... D06M 15/53; D06M 15/277

(52) U.S. Cl. ..... 252/8.83; 252/8.81; 252/8.84; 8/115.6

(58) Field of Search ..... 252/8.81, 8.83, 252/8.84; 8/115.6

(56) References Cited

U.S. PATENT DOCUMENTS

| | | | | |
|---|---|---|---|---|
| 4,497,720 A | | 2/1985 | Moriga | 252/52 |
| 6,120,695 A | * | 9/2000 | Hauser | 252/8.81 |
| 6,537,662 B1 | * | 3/2003 | Kamrath et al. | 428/375 |

FOREIGN PATENT DOCUMENTS

| | | | |
|---|---|---|---|
| EP | 102240 | 3/1984 | |
| EP | 0 605 727 A1 | 7/1994 | |
| JP | 57-82572 | 5/1982 | D06M/13/08 |
| JP | 62-44069 | 2/1987 | H02M/3/28 |
| JP | 62-44072 | 2/1987 | H02M/5/27 |
| JP | 63-50529 | 3/1988 | D01F/11/08 |
| JP | 63-57548 | 3/1988 | C07C/55/21 |
| JP | 6-21380 | 1/1994 | H01L/27/108 |
| JP | 11-61645 | 3/1999 | D06M/15/53 |
| WO | 99/43884 | 9/1999 | D06M/15/53 |

OTHER PUBLICATIONS

Derwent Abstract No. 1988–128430, abstract of Japanese Patent Publication No. 06–21380 (Mar. 1994).*

* cited by examiner

*Primary Examiner*—Anthony J. Green
(74) *Attorney, Agent, or Firm*—Sughrue Mion, PLLC

(57) ABSTRACT

It is an object of the invention to provide a spin finish generating neither tar nor scum in false twisting treatment either of the hot plate contact heating type or of the non-contact heating type using a radiation type high temperature heater and thus enabling long term stable false twisting treatment.

This invention provides a spin finish for synthetic fibers which satisfies the following relations (1) and (2):

$$10 \leqq T \leqq 22 \quad (1)$$

$$0 \leqq Re \leqq 0.25 \quad (2)$$

where T is the surface tension (mN/m) of the oil after allowing the same to stand at 220° C. for 1 hour and Re is the percent residue (% by weight) on heating of the oil after allowing the same to stand at 400° C. for 24 hours.

21 Claims, No Drawings

SPINNING OIL FOR SYNTHETIC FIBER

TECHNICAL FIELD

The present invention relates to a spin finish for synthetic fibers. More particularly, it relates to a spin finish suited for thermoplastic synthetic fibers submitted to false twisting.

BACKGROUND ART

An oil containing a small amount of a polyalkylene oxide-modified polysiloxane (Japanese Kokoku Publication Sho-63-57548), an oil containing a perfluoro group-containing compound showing specific thermal decomposition behavior (Japanese Kokoku Publication Sho-62-44072) and an oil containing a copolymer derived from a fluorinated alkyl-containing monomer and a polyoxyalkylene group-containing monomer (Japanese Kokai Publication Hei-11-61645), among others, have been hithertofore proposed as the spin finish for fibers submitted to false twisting.

However, with the oil containing a small amount of a modified polysiloxane, a problem has been pointed out; namely, in high-speed false twisting treatment using a radiation type high temperature heater, which has recently been put to practical use, the heater temperature reaches 400° C. or above, so that silica (ash) formed upon thermal decomposition sticks fast to the guide within the heater, increasing the incidence of fluff and yarn breaking.

Of the fluorine compound-containing oils, the former requires a relatively large amount of the perfluoro group-containing compound and this markedly increases the cost of the oil and, in addition, the perfluoroalkyl-containing compound may possibly contaminate the yarn guide and a gas generated upon decomposition thereof may possibly wear the machine, hence the former is not practical, while the latter has a problem from the viewpoint of stable operation in long-period false twisting, since the perfluoro group-containing compound is thermally unstable.

DISCLOSURE OF INVENTION

It is an object of the invention to provide a spin finish generating neither tar nor scum in false twisting treatment either of the hot plate contact heating type or of the non-contact heating type using a radiation type high temperature heater and thus enabling long term stable false twisting treatment.

As a result of intensive investigations made by them to accomplish the above object, the present inventors found that when, in false twisting of the hot plate contact heating type or in high speed false twisting using a radiation type high temperature heater, the surface tension of the spin finish in a high temperature condition, more specifically the surface tension after allowing to stand at 220° C. for 1 hour, is adjusted 10 to 22 mN/m, the spreading of the oil over the hot plate and the formation of tar can be suppressed, whereby prolonged stable operations become possible in the step of false twisting. They further succeeded in preventing the induced occurrence of fluff and yarn breaking by reducing the amount of tar, which is unavoidably formed although the amount is small, before its becoming ashed by heat, more specifically the percent residue upon heating of the spin finish after allowing to stand at 400° C. for 24 hours, to 0.25% by weight or below.

In addition, it was found that by controlling the kinematic viscosity behavior of the spin finish after a certain period of heating within a certain range, it is possible to prevent yarn breaking for a more prolonged period of time.

Thus, the present invention is directed to a spin finish for synthetic fibers which satisfies the relations (1) and (2):

$$10 \leqq T \leqq 22 \quad (1)$$

$$0 \leqq Re \leqq 0.25 \quad (2)$$

where T is the surface tension (mN/m) of the oil after allowing the same to stand at 220° C. for 1 hour and Re is the percent residue (% by weight) on heating of the oil after allowing the same to stand at 400° C. for 24 hours.

In the following, the invention is described in detail.

When the spin finish satisfies the relations (1) and (2), the amount of tar formed on the hot plate is slight in false twisting by hot plate contact heating and, in false twisting by non-contact heating using a radiation type high temperature heater, the deposit of scum inside the heater is slight and, thus, in either case, stable operations become very easy to carry out even in a long-term false twisting process.

More preferably, T and Re satisfy the following relations (3) and (4), respectively and, still more preferably, they satisfy the relations (5) and (6), respectively.

$$10 \leqq T \leqq 20 \quad (3)$$

$$0 \leqq Re \leqq 0.20 \quad (4)$$

$$10 \leqq T \leqq 15 \quad (5)$$

$$0 \leqq Re \leqq 0.15 \quad (6)$$

The methods of measuring T and Re are now described.

<Method of measuring the surface tension (T) after standing at 220° C. for 1 hour>

Twenty-five grams of the oil to be tested is weighed in a stainless steel dish, 60 mm in inside diameter and 15 mm in depth, and the whole is allowed to stand on a hot plate maintained at 220±1° C. for 1 hour. After standing, the surface tension is measured at 220° C. using an automatic surface tension meter (e.g. Kyowa Kaimen Kagaku model CBVP-A3).

<Method of measuring the percent residue (Re) on heating after standing at 400° C. for 24 hours>

About one gram (W2) of the oil to be tested is accurately weighed in a platinum dish with a known weight (W1). The whole is heated in a tubular electric furnace (e.g. Isuzu Seisakusho model AT-E58) at 400° C. for 24 hours and then the platinum dish plus residue on heating is accurately weighed (W3) and the percent residue on heating is calculated according to the equation (11):

$$\text{Percent residue on heating } (\%) = [(W3 - W1)/(W2 - W1)] \times 100 \quad (11)$$

Further, the spin finish of the invention preferably satisfies the following relation (7):

$$0.5 \leqq V2/V1 \leqq 60 \quad (7)$$

where V2 is the kinematic viscosity ($mm^2/s$) of the oil at 25° C. after allowing the same to stand at 220° C. for 12 hours and V1 is the kinematic viscosity ($mm^2/s$) of the oil at 25° C. before standing.

When V1 and V2 satisfy the relation (7), the viscosity increasing behavior of the heated spin finish is controlled in a certain range and, therefore, the dropping of the oil onto the heater is slight and the formation of tar and/or ash is still more reduced, hence yarn damaging decreases and yarn breaking and fluff become more scarce, so that yarns of good quality can be obtained stably for a still prolonged period of time.

More preferably, V1 and V2 satisfy the relation (8):

$$0.8 \leqq V2/V1 \leqq 50 \quad (8)$$

The method of measuring V1 and V2 are now described.

<Method of measuring the kinematic viscosity (V1) of the oil at 25° C. before standing at 220° C.>

Fifty grams of the oil to be tested is conditioned at 25° C. for 1 hour and then the kinematic viscosity is measured using an Ubbellohde viscometer.

<Method of measuring the kinematic viscosity (V2) of the oil at 25° C. after 12 hours of standing at 220° C.>

Fifty grams of the oil to be tested is placed in a 100 ml glass beaker and the whole is allowed to stand in a circulating air type drier controlled at 220±1° C. for 12 hours. After standing, this is conditioned at 25° C. for 1 hour and then the kinematic viscosity is measured in the same manner as V1 measurement.

The components constituting the spin finish of the invention are not particularly restricted in oil but, in specific examples suited for the purpose of the invention, the oil comprises one or more polyether type lubricants (A) and another component or other components (B).

First, the component (A) is illustrated.

Usable as (A) are compounds obtained by (co) polymerizing an alkylene oxide(s) containing 2 to 4 carbon atoms with a compound having one or more hydroxyl groups within the molecule, and modifications derived therefrom by modifying the terminal hydroxyl group thereof.

Usable as the compound having one or more hydroxyl groups within the molecule are natural or synthetic aliphatic alcohols, aromatic alcohols, alicyclic alcohols and phenols containing 1 to 30 carbon atoms.

As the aliphatic alcohols, there can be mentioned saturated straight chain monohydric alcohols, saturated branched monohydric alcohols, unsaturated straight chain monohydric alcohols, unsaturated branched monohydric alcohols, saturated straight chain dihydric alcohols, saturated branched dihydric alcohols, unsaturated straight chain dihydric alcohols, unsaturated branched dihydric alcohols, tri- to octahydric or further polyhydric alcohols and the like.

As the saturated straight chain monohydric alcohols, there may be mentioned, among others, methanol, ethanol, butanol, n-amyl alcohol, octyl alcohol, decyl alcohol, lauryl alcohol, myristyl alcohol, cetyl alcohol and stearyl alcohol.

As the saturated branched monohydric alcohols, there may be mentioned, among others, isopropanol, sec-amyl alcohol, tert-amyl alcohol, isoamyl alcohol, 2-ethylhexyl alcohol, isodecyl alcohol, isotridecyl alcohol, secondary alcohols containing 12 or 14 carbon atoms, isocetyl alcohol and isostearyl alcohol.

As the unsaturated straight chain monohydric alcohols, there may be mentioned, among others, allyl alcohol, crotyl alcohol and oleyl alcohol.

As the unsaturated branched monohydric alcohols, there may be mentioned, among others, methylvinylcarbinol, 3-buten-2-ol and 4-penten-3-ol.

As the saturated straight chain dihydric alcohols, there maybe mentioned, among others, ethylene glycol, propylene glycol and hexylene glycol.

As the saturated branched dihydric alcohols, there may be mentioned, among others, neopentyl glycol and 2,2-diethyl-1,3-propanediol.

As the unsaturated straight chain dihydric alcohols, there may be mentioned, among others, 2-butene-1,4-diol and 4-hexene-2,3-diol.

As the unsaturated branched dihydric alcohols, there may be mentioned, among others, 2-methyl-3-pentene-1,2-diol and 7-ethyl-4-octene-2,3-diol.

As the tri- to octahydric or further polyhydric alcohols, there may be mentioned, among others, glycerol, glycerol dimer to hexamer, trimethylolpropane, trimethylolpropane dimer to tetramer, pentaerythritol, pentaerythritol dimer to tetramer, sorbitan, sorbitol, sucrose and fructose.

As aromatic alcohols, there maybe mentioned, among others, benzyl alcohol, 2-phenylethanol, α-phenylethyl alcohol, triphenylcarbinol and cinnamyl alcohol.

As the alicyclic alcohols, there may be mentioned, among others, cyclopentanol, cyclohexanol and cis-1,2-cyclopentanediol.

As the phenols, there may be mentioned, among others, phenol, alkylphenols whose alkyl moiety contains 1 to 20 carbon atoms (e.g. cresol, octylphenol, nonylphenol, dinonylphenol, etc.), bisphenols (e.g. bisphenol A, bisphenol F, bisphenol S, etc.), catechol and naphthol.

As the alkylene oxide containing 2 to 4 carbon atoms, there may be mentioned, among others, ethylene oxide (hereinafter referred to as EO for short), propylene oxide (hereinafter referred to as PO for short), butylene oxide (hereinafter referred to as BO for short) and tetrahydrofuran.

When EO is copolymerized with another alkylene oxide, the content of EO is generally 5 to 90% by weight, preferably 20 to 80% by weight, based on the total amount of the alkylene oxides. The mode of addition for copolymerization may be of the random addition type or of the block addition type.

Useful as the modifications of the (co)polymerization product compound as derived by modifying the terminal hydroxyl group are modifications obtained by modifying the terminal hydroxyl group with an alkyl halide containing 1 to 12 carbon atoms, a monocarboxylic acid containing 1 to 12 carbon atoms, a dicarboxylic acid containing 2 to 18 carbon atoms, a dihalogenated alkane containing 1 to 12 carbon atoms, or an aliphatic, alicyclic or aromatic diisocyanate containing 4 to 20 carbon atoms (excluding the NCO-forming carbon atoms), for instance.

As the alkyl halide containing 1 to 12 carbon atoms, there may be mentioned, among others, methyl chloride, ethyl bromide, butyl chloride and undecyl bromide (modifications: alkoxylation products).

As the monocarboxylic acid containing 1 to 12 carbon atoms, there may be mentioned, among others, acetic acid, propionic acid, octanoic acid and undecanoic acid (modifications: esterification products).

As the dicarboxylic acid containing 2 to 18 carbon atoms, there maybe mentioned, among others, oxalic acid, malonic acid, succinic acid, glutaric acid, adipic acid, maleic acid, fumaric acid and phthalic acid (modifications: esterification products, polyesterification products).

As the dihalogenated alkane containing 1 to 12 carbon atoms, there may be mentioned, among others, methylene dichloride, ethylene dibromide and decylene dibromide (modifications: dimerization products, polymerization products).

As the aliphatic, alicyclic or aromatic diisocyanate containing 4 to 20 carbon atoms (excluding the NCO-forming carbon atoms), there may be mentioned, among others, hexamethylene diisocyanate, cyclohexyl isocyanate and phenyl isocyanate (modifications: urethanes, polymerization products).

The component (A) preferably has a weight average molecular weight (hereinafter referred to as MW for short) of 400 to 20,000, more preferably 1,000 to 15,000, as determined by gel permeation chromatography (hereinafter referred to as GPC for short).

The component (A) preferably has a pour point of not higher than 40° C., more preferably not higher than 20° C.

The component (A) preferably has a viscosity at 100° C. of 5 to 1,000 cst, more preferably 10 to 300 cst.

As specific examples of (A), there may be mentioned, among others, a butanol-based (EO/PO) random adduct (EO/PO=50/50% by weight, MW=1,800), a lauryl alcohol-based (PO/EO) block adduct (EO/PO=40/60% by weight, MW=1,400), a hexylene glycol-based (EO/PO) random adduct (EO/PO=40/60% by weight, MW=4,000), the dimethyl etherified derivative of a trimethylolpropane-based (PO/EO) block adduct (EO/PO=20/80% by weight, MW=5,000), the dicaprylate of a pentaerythritol-based (EO/PO) random adduct (EO/Po=50/50% by weight, MW=3,000), the product obtained by dimerization with dichloromethane of a butanol-based (EO/PO) random adduct (EO/PO=50/50% by weight, MW=800) and the product obtained by urethane formation reaction with hexamethylene diisocyanate of a butanol-based (EO/PO) random adduct (EO/PO=50/50% by weight, MW=800).

The polyether type lubricant (A) is used preferably in an amount of 60 to 98% by weight, more preferably 70 to 97% by weight, based on the total weight of the spin finish.

Now, an explanation is made of the other component(s) (B).

The composition of (B) is not particularly restricted but (B) preferably comprises a constituent (B1) capable of causing the spin finish after mixing up to show a surface tension of not higher than 22 mN/m after 1 hour of standing at 220° C., more preferably not higher than 20 mN/m (constituent B11), still more preferably not higher than 15 mN/m (constituent B12).

Further, a constituent (B13) capable of causing the kinematic viscosity of the spin finish to satisfy the relation (7) is preferred. A constituent (B14) capable of causing the kinematic viscosity to satisfy the relation (8) is more preferred.

Usable as (B1) are, for example, compounds (B1-A) having a perfluoroalkyl and/or perfluoroalkylene group (hereinafter referred to as Rf group for short), silicone oils (B1-B) and mixtures of these with a regulator (B1-C).

The compound (B1-A) is not particularly restricted but includes those compounds having an Rf group and preferably having a fluorine content, based on the weight of (B1-A), of 3 to 60% by weight, more preferably 5 to 40% by weight, still more preferably 7 to 35% by weight.

Usable as the Rf group are straight groups containing 2 to 20 carbon atoms as synthesized by telomerization or electrolytic fluorination (tetrafluoroethylene group, hexafluoropropylene group, perfluorohexyl group, perfluorooctyl group, perfluorododecyl group, perfluorocetyl group, perfluorooctadecylene group, etc.) and branched groups containing 2 to 20 carbon atoms as resulting from oligomerization. Among them, straight ones containing 6 to 14 carbon atoms obtained by telomerization are preferred.

From the compatibility viewpoint with (A), it is preferred that (B1-A) further have a polyoxyalkylene chain within the molecule.

The weight percentage of the polyoxyalkylene chain moiety of such compounds is preferably 20 to 95% by weight, more preferably 30 to 90% by weight, based on the weight of (B1-A).

From the viewpoint of preventing the tar formation on the hot plate, (B1-A) is preferably an oligomer or polymer and the MW thereof as determined by GPC is preferably 3,000 to 700, 000, more preferably 4,000 to 600,000, still more preferably 5,000 to 500,000.

Further, it is preferred that (B1-A) have the Rf group on its side chain.

In cases where (B1-A) is an oligomer or polymer, it can be obtained by subjecting an Rf-containing monomer to such a mode of polymerization as vinyl addition polymerization (B1-A-1), polycondensation (B1-A-2), polyaddition (B1-A-3) or ring opening polymerization (B1-A-4).

The oligomer or polymer (B1-A-1) resulting from vinyl addition polymerization is obtained (co)polymerizing a perfluoroalkyl-containing vinyl monomer (b1) as an essential monomer, if necessary with a vinyl monomer (b2) having a polyoxyalkylene chain and/or another vinyl monomer (b3). A copolymer obtained from (b1) and (b2) as essential monomers is preferred.

Usable as (b1) are compounds represented by the following general formula (9), for instance:

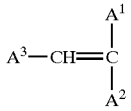

(9)

In the above formula, $A^1$ represents a group of the formula Rf—X—$(OE^1)_m$—Q—$(CH_2)_n$— (hereinafter referred to as G— for short), a group of the formula G—$OCH_2$—$(CHOH)_{4-p}$(CHO—G)$_p$—Q—$(CH_2)_n$— or a group of the formula —$C_6H_{5-q}$(—O—G)$_q$;

$A^2$ and $A^3$ are the same or different and each represents a hydrogen atom, a methyl group or a group of the formula Rf—X—$(OE^1)_m$—Q—$(CH_2)_n$— or of the formula $R^3$—X—$(OE^1)_m$—Q— $(CH_2)$ n—. In each formula, Rf represents a perfluoroalkyl group containing 3 to 18 carbon atoms.

X represents a group of the formula —$(CH_2)_r$—, a group of the formula —$SO_2NR^1$—$E^2$— or a group of the formula —$CONR^2$—$E^2$— (in which r represents 0 or an integer of 1 to 4, $R^1$ and $R^2$ are the same or different and each represents a hydrogen atom or an alkyl group containing 1 to 8 carbon atoms and $E^2$ represents an alkylene group containing 1 to 8 carbon atoms).

$E^1$ represents an alkylene group containing 2 to 4 carbon atoms.

m represents 0 or an integer of 1 to 20.

Q represents a group of the formula —OCO—, a group of the formula —O— or a group of the formula —NHCO—.

n represents 0 or an integer of 1.

p represents 0 or an integer of 1 to 4.

q represents an integer of 1 to 5.

$R^3$ represents an alkyl or acyl group containing 1 to 12 carbon atoms.

In the general formula (9), $OE^1$ comprises one or more oxyalkylene groups selected from among oxyethylene, oxypropylene and oxybutylene groups and, when m is 2 or more, the $OE^1$ groups may be the same or different and the $(OE^1)$ moieties may be in a random addition or block addition mode. Q is preferably a group represented by —OCO— and n is preferably 0.

Further, X preferably represents a group of formula $(CH_2)_r$— or a group of formula —$SO_2NR^1$—$E^2$— and more preferably represents a group of formula —$(CH_2)_r$— in which r is an integer of 1 to 4.

Preferably, at least one of $A^2$ and $A^3$ represents a group of the formula Rf—X—$(OE^1)_m$—Q—$(CH_2)_n$— or a group of the formula $R^3$—X—$(OE^1)_m$—Q—$(CH_2)_n$—. Further, it is preferred that $A^3$ represents a group of the formula Rf—X—$(OE^1)_m$—Q—$(CH_2)_n$— or a group of the formula $R^3$—X—$(OE^1)_m$—Q—$(CH_2)_n$—.

The proportion of (b1) to be used in (B1-A-1) is preferably 5 to 80 mole percent, more preferably 10 to 70 mole percent, still more preferably 15 to 65 mole percent, most preferably 35 to 65 mole percent, based on the total number of moles of (b1), (b2) and (b3).

As specific examples of (b1), there maybe mentioned, among others, the following compounds:

$C_8F_{17}CH_2CH_2OCOCH{=}CH_2$ (b1-1).

$C_8F_{17}CH_2CH_2OCOC(CH_3){=}CH_2$ (b1-2)

$C_8F_{17}SO_2N(C_3H_7)(CH_2)_2(OC_2H_4)_5OCOCH{=}CH_2$ (b1-3)

$C_8F_{17}CH_2CH_2OCOCH{=}CHOCOCH_2CH_2C_8F_{17}$ (b1-4)

Usable as (b2) are compounds represented by the following general formula (10), for instance:

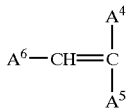

(10)

In the above formula, $A^4$ represents a group of the formula $R^4$—$(OE^3)_s$—Z—$(CH_2)_t$—(hereinafter referred to as J— for short), a group of the formula J—$OCH_2$—$(CHOH)_{4-p}(CHO—J)_p$—Z—$(CH_2)_t$— or a group of the formula —$C_6H_{5-q}(O—J)_q$.

$A^5$ and $A^6$ are the same or different and each represents a hydrogen atom, a methyl group or J—.

In each formula, $R^4$ represents a hydrogen atom or an alkyl or acyl group containing 1 to 12 carbon atoms.

$E^3$ represents an alkylene group containing 2 to 4 carbon atoms.

s represents an integer of 1 to 200.

Z represents a group of the formula —OCO—, a group of the formula —O— or a group of the formula —NHCO—.

t represents 0 or an integer of 1 to 12.

p represents 0 or an integer of 1 to 4.

q represents an integer of 1 to 5.

In the general formula (10), $OE^3$ comprises one or more oxyalkylene groups selected from among oxyethylene, oxypropylene and oxybutylene groups. When s is 2 or more, the $OE^3$ groups may be the same or different. Preferred, however, are combinations of oxyethylene (OEt) and oxypropylene (OPr) groups preferably with a weight ratio of OEt/OPr=8/2 to 2/8. In that case, the mode of addition of OEt and OPr may be random addition or block addition.

Further, s is preferably 2 to 200, more preferably 10 to 180, most preferably 15 to 150.

Preferably, at least one of $A^5$ and $A^6$ is J—. Further, it is preferred that $A^6$ is J—.

The MW of (b2) as determined by GPC is preferably 200 to 9,000, more preferably 300 to 8,000. Z is preferably a group of the formula —OCO—.

The proportion of (b2) is preferably 0 or 0.1 to 60 mole percent, more preferably 0 or 10 to 50 mole percent, most preferably 0 or 15 to 45% by weight, based on the total number of moles of (b1), (b2) and (b3).

In (B1-A-1), another vinyl monomer (b3) may be used as a constituent unit, as necessary.

Usable as (b3) are alkyl (meth) acrylates whose alkyl moiety contains 1 to 20 carbon atoms, esters of silicon-containing alcohols and (meth)acrylic acid, esters of sulfur-containing alcohols and (meth)acrylic acid, ethylenic monomers, vinyl acetate and the like.

As the alkyl (meth) acrylates whose alkyl moiety contains 1 to 20 carbon atoms, there maybe mentioned methyl (meth) acrylate, ethyl (meth)acrylate, butyl (meth)acrylate, 2-ethylhexyl (meth)acrylate and decyl (meth)acrylate, among others.

As the silicon-containing alcohols, there may be mentioned, among others, polysiloxanes modified with a hydroxyalkyl group containing 3 to 20 carbon atoms and having a kinematic viscosity of 5 to 10,000/25° C. and polysiloxanes modified by addition of an alkylene oxide containing 2 to 4 carbon atoms (the number of moles added being 1 to 30) and having a kinematic viscosity of 5 to 10,000/25° C.

As the sulfur-containing alcohols, there may be mentioned, among others, thiodiglycol and alkylthioethanols containing 4 to 16 carbon atoms.

As the ethylenic monomers, there may be mentioned, among others, α-olefins containing 2 to 20 carbon atoms, such as ethylene, propylene and 1-dodecene.

The proportion of (b3) is preferably 0 or 0.1 to 80 mole percent, more preferably 0 or 5 to 70 mole percent, still more preferably 0 or 10 to 70 mole percent, most preferably 0 or 10 to 50 mole percent, based on the total number of moles of (b1), (b2) and (b3). (B1-A-1) can be produced by subjecting to the above monomer(s) to ordinary radical polymerization and the method of polymerization can be selected from among solution polymerization, bulk polymerization, suspension polymerization and other methods.

As for the polymerization initiator, it is not particularly restricted but includes, for example, azo initiators, peroxide initiators, polyfunctional initiators having two or more peroxide group in each molecule, and polyfunctional initiators having one or more peroxide groups and one or more polymerizable unsaturated groups in each molecule.

As the azo initiators, there may be mentioned azobisisobutyronitrile and azobisisovaleronitrile, for instance.

As the peroxide initiators, there may be mentioned, among others, benzoyl peroxide, di-tert-butyl peroxide, lauroyl peroxide and dicumyl peroxide.

As the polyfunctional initiators having two or more peroxide group in each molecule, there may be mentioned, among others, 2,2-bis(4,4-di-tert-butylperoxycyclohexyl) propane, 1,1-bis(tert-butylperoxy)-3,3,5-trimethylcyclohexane and di-tert-butylperoxy hexahydroterephthalate.

As the polyfunctional initiators having one or more peroxide groups and one or more polymerizable unsaturated groups in each molecule, there may be mentioned, among others, diallyl peroxydicarbonate and tert-butylperoxy allyl carbonate.

As for the solvent to be used in the production by solution polymerization, it is not particularly restricted but includes any of aromatic solvents (e.g. toluene, xylene, ethylbenzene, etc.), ester solvents (e.g. ethyl acetate, butyl acetate, etc.), ketones (e.g. methyl ethyl ketone, acetone), polar solvents (e.g. dimethylformamide, dimethyl sulfoxide) and the like.

The polymerization temperature is preferably 70 to 210° C., more preferably 75 to 200° C. As for the atmosphere during polymerization, the polymerization is preferably carried out in a substantially oxygen-free condition, for example in the presence of an inert gas such as nitrogen, or in an atmosphere comprising the vapor of the solvent used.

Specific examples of (B1-A-1) include, but are not limited to, the following oligomers:

(1) An oligomer (fluorine content=15% by weight, MW=30,000) obtained by copolymerization of the acrylate of $C_8F_{17}C_2H_4OH$ (50 mole percent), the monoacrylate of a polypropylene glycol (MW=1750)–EO (30 moles) adduct (25 mole percent) and methyl methacrylate (25 mole percent);

(2) An oligomer (fluorine content=14% by weight, MW=18,600) obtained by copolymerization of the acrylate of $C_8F_{17}C_2H_4OH$ (40 mole percent), the acrylate of a butanol-PO (20 moles)/EO (12 moles) adduct (40 mole percent) and methyl methacrylate (20 mole percent);

(3) An oligomer (fluorine content=21% by weight, MW 12,000) obtained by copolymerization of the acrylate of $C_8F_{17}SO_2N(C_3H_7)$ $C_2H_4OH$—EO (5 moles) adduct (40 mole percent), the acrylate of a methanol-EO (15 moles) adduct (30 mole percent) and methyl methacrylate (30 mole percent);

(4) An oligomer (fluorine content=18% by weight, MW=150,000) obtained by copolymerization of the acrylate of $C_8F_{17}C_2H_4OH$ (50 mole percent), the acrylate of a butanol-EO (20 moles)/PO (15 moles) random adduct (30 mole percent) and methyl methacrylate (20 mole percent);

(5) An oligomer (fluorine content=14% by weight, MW=26,700) obtained by copolymerization of the fumaric acid diester derived from $C_8F_{17}C_2H_4OH$ (25 mole percent), the acrylate of a butanol-EO (20 moles)/PO (20 moles) random adduct (40 mole percent) and methyl methacrylate (35 mole percent); and (6) An oligomer (fluorine content=13% by weight, MW=21,300) obtained by copolymerization of the acrylate of $C_8F_{17}C_2H_4OH$ (35 mole percent), the fumaric acid monoester derived from a butanol-EO (20 moles)/PO (15 moles) random adduct (35 mole percent) and methyl methacrylate (30 mole percent).

The oligomer or polymer (B1-A-2) obtained by polycondensation is the polymer polymerized through ester linkages or amide linkages within the molecule.

The polymer polymerized through ester linkages is obtained by direct esterification from a carboxylic acid and an alcohol or by transesterification between a carboxylic acid ester and an alcohol, for instance. Thus, for example, the polymer is obtained by polycondensation of a mono- or polyhydric alcohol having an Rf group with a mono-, di- or tricarboxylic acid and/or an esterification product derived therefrom, by polycondensation of a mono- or polybasic carboxylic acid having an Rf group and/or an esterification product derived therefrom with a mono- or polyhydric alcohol, or by polycondensation of a mono- or polyhydric alcohol having an Rf group, if necessary together with another mono- or polyhydric alcohol, with a mono- or polybasic carboxylic acid having an Rf group, if necessary together with another mono-, di- or tricarboxylic acid and/or an esterification product derived therefrom.

Usable as the mono- or polyhydric alcohol having an Rf group are alcohols the Rf group of which contains 1 to 18 carbon atoms, for example $C_2F_5CH_2OH$, $C_4F_9CH_2CH_2OH$, $C_8F_{17}CH_2CH_2OH$, $C_8F_{17}SO_2N(C_3H_7)$ $CH_2CH_2OH$, $C_8F_{17}CH(OH)CH_2OH$ and $C_8F_{17}OCH_2CH(OH)CH_2OH$, and alkylene oxide (containing 2 to 4 carbon atoms) adducts (the number of moles added being 1 to 20) derived from those alcohols as well as hydroxyl-containing Rf compounds obtained by reacting an Rf-containing epoxy compound with a carboxylic acid.

Usable as the other mono- or polyhydric alcohol are those compounds having one or more hydroxyl group within the molecule as given hereinabove as examples in describing (A) and, further, alkylene oxide (e.g. EO, PO, BO) adducts (1 to 50 moles added) derived therefrom [e.g. alkylene ether glycols (e.g. diethylene glycol, triethylene glcyol, dipropylene glycol, polyethylene glycol with MW=200 to 1,000, polypropylene glycol with MW=200 to 1,000, polytetramethylene glycol with MW=200 to 1,000).

When two or more alkylene oxides are added, the mode of addition may be random addition or block addition.

Usable as the mono- or polybasic carboxylic acid having an Rf group are carboxylic acids whose Rf group contains 1 to 18 carbon atoms, for example $CF_3COOH$, $C_3F_7COOH$, $C_7F_{15}COOH$, $C_8F_{17}COOH$, $C_8F_{17}CH(COOH)CH_2COOH$ and $HOOCCH_2C_8F_{16}CH_2COOH$.

Usable as the other mono-, di- or tricarboxylic acid are monocarboxylic acids containing 1 to 18 carbon atoms, aliphatic dicarboxylic acids containing 2 to 20 carbon atoms, alicyclic dicarboxylic acids containing 6 to 20 carbon atoms and aromatic dicarboxylic acids containing 6 to 20 carbon atoms, and anhydrides of these carboxylic acids, as well as trimellitic anhydride and the like.

As the monocarboxylic acids containing 1 to 18 carbon atoms, there may be mentioned, among others, saturated straight chain carboxylic acids such as acetic acid, butyric acid, lauric acid and stearic acid, saturated branched carboxylic acids such as 2-ethylhexanoic acid and isostearic acid, and unsaturated carboxylic acids such as acrylic acid, methacrylic acid, oleic acid and linolic acid.

As the aliphatic dicarboxylic acids containing 2 to 20 carbon atoms, there may be mentioned, among others, maleic acid, fumaric acid, succinic acid, dodecenylsuccinic acid, adipic acid, sebatic acid, malonic acid, azelaic acid, mesaconic acid, citraconic acid and glutaconic acid.

As the alicyclic dicarboxylic acids containing 6 to 20 carbon atoms, there may be mentioned, among others, cyclohexanedicarboxylic acid and methylmedic acid.

As the aromatic dicarboxylic acids containing 6 to 20 carbon atoms, there may be mentioned, among others, phthalic acid, isophthalic acid, terephthalic acid, toluenedicarboxylic acid and naphthalenedicarboxylic acid.

Esterification products (e.g. alkyl (containing 1 to 4 carbon atoms) esters, such as methyl and butyl esters) derived from these can also be used for the transesterification reaction.

The ratio between the carboxylic acid and alcohol is preferably 0.6 to 1.6, more preferably 0.7 to 1.5, still more preferably 0.8 to 1.4, as expressed in terms of hydroxyl equivalent/carboxyl equivalent ratio.

The reaction is carried out in the presence of a catalyst, preferably at a temperature of 150° C. to 300° C., more preferably 170 to 280° C. The reaction can also be carried out at ordinary pressure or under reduced pressure or under pressurization.

Usable as the catalyst are those catalysts generally used for the production of polyesters, for example, metals (e.g. tin, titanium, antimony, manganese, nickel, zinc, lead, iron, magnesium, calcium, germanium, etc.), compounds containing these metals (e.g. dibutyltin oxide, ortho-dibutyl titanate, tetrabutyl titanate, zinc acetate, lead acetate, cobalt acetate, sodium acetate, antimony trioxide, etc.), sulfuric acid, hydrochloric acid and organic acids (p-toluenesulfonic acid, methanesulfonic acid, etc.).

The polymer polymerized through amide linkages can be produced, for example, by polycondensation of a monocarboxylic acid having an Rf group, and if necessary another mono-, di- or tricarboxylic acid, with a mono- or polyamine or by polycondensation of a mono-, di- or tricarboxylic acid with a mono- or polyamine having an Rf group.

Usable as the monocarboxylic having an Rf group and the other mono-, di- or tricarboxylic acid are the same ones as mentioned above.

Usable as the mono- or polyamine having an Rf group are amines having an Rf group containing 1 to 18 carbon atoms, for example $C_4F_9CH_2CH_2CH_2NH_2$, $C_8F_{17}CH_2CH_2CH_2NH_2$, $C_8F_{17}CH_2CH_2CH_2NHCH_2CH_2CH_2NH_2$, $C_8F_{17}CH_2CH_2CH_2N(CH_2CH_2CH_2NH_2)_2$, $C_4F_9CH_2CH_2OCH_2CH_2CH_2NH_2$, $C_8F_{17}CH_2CH_2OCH_2CH_2CH_2NH_2$, $C_8F_{17}CH_2CH_2OCH_2CH_2CH_2NHCH_2CH_2CH_2NH_2$ and $C_8F_{17}CH_2CH_2OCH_2CH_2CH_2N(CH_2CH_2CH_2NH_2)_2$.

Usable as the mono- or polyamine are aliphatic alkylamines containing 1 to 12 carbon atoms, alkylenediamines containing 2 to 12 carbon atoms, polyalkylene glycol-drived diamines, alicyclic amines containing 6 to 20 carbon atoms and aromatic amines containing 6 to 20 carbon atoms.

As the aliphatic alkylamines containing 1 to 12 carbon atoms, there may be mentioned, among others, ethylamine, propylamine, octylamine and laurylamine.

As the alkylenediamines containing 2 to 12 carbon atoms, there may be mentioned, among others, ethylenediamine, propylenediamine, trimethylenediamine, tetramethylenediamine and hexamethylenediamine.

As the polyalkylene glycol-drived diamines, there may be mentioned, among others, polyethylene glycol (MW=400) diaminopropyl ether and diaminopropyl ether of polypropylene glycol (MW=1,750)-EO (30 moles) adduct.

As the alicyclic amines containing 6 to 20 carbon atoms, there may be mentioned, among others, cyclohexylamine, 1,3-diaminocyclohexane, isophoronediamine, menthandiamine and 4,4'-methylenedicyclohexanediamine (hydrogenated methylenedianiline).

As the aromatic amines containing 6 to 20 carbon atoms, there may be mentioned, among others, phenylamine, 1,2-, 1,3- or 1, 4-phenylenediamine, 2,4'-or 4,4'-diphenylmethanediamine, diaminodiphenyl sulfone, benzidine, thiodianiline, bis(3,4-diaminophenyl) sulfone, 2,6-diaminopyridine, m-aminobenzylamine, triphenylmethane-4,4',4"-triamine and naphthylenediamine.

The ratio between the carboxylic acid and amine is preferably 0.6 to 1.6, more preferably 0.7 to 1.5, most preferably 0.8 to 1.4, as expressed in terms of amino equivalent/carboxyl equivalent ratio.

The reaction is carried out in the presence of a catalyst, preferably at a temperature of 140° C. to 250° C., more preferably 180 to 230° C. The reaction can also be carried out at ordinary pressure or under reduced pressure or under pressurization. Usable as the catalyst are the same ones as those mentioned above for polyester production.

The polymer polymerized through ester linkages and amide linkages can be produced, for example, by polycondensation of a mono carboxylic acid having an Rf group, and if necessary another mono-, di- or tricarboxylic acid, with a mono- or polyhydric alcohol and a mono- or polyamine, by polycondensation of a mono-, di- or tricarboxylic acid with a mono- or polyhydric alcohol and a mono- or polyamine having an Rf group, or by polycondensation of a mono-, di- or tricarboxylic acid with a mono- or polyhydric alcohol having an Rf group and a mono- or polyamine.

Usable as the monocarboxylic acid having an Rf group, the other mono-, di- or tricarboxylic acid, the mono- or polyhydric alcohol, the mono- or polyamine, the mono- or polyamine having an Rf group and the mono- or polyhydric alcohol having an Rf group are the same ones as mentioned above.

The ratio between the carboxylic acid, alcohol and amine is preferably 0.6 to 1.6, more preferably 0.7 to 1.5, still more preferably 0.8 to 1.4, as expressed in terms of (hydroxyl equivalent plus amino equivalent)/carboxyl equivalent ratio. The hydroxyl equivalent-to-amino equivalent ratio is generally within the range of hydroxyl equivalent: amino equivalent=100:0 to 0:100, preferably 100:0 or 0:100 or within the range of 90:10 to 10:90, more preferably 100:0 or 0:100 or within the range of 80:20 to 20:80.

The reaction is carried out in the presence of a catalyst, preferably at a temperature of 140° C. to 250° C., more preferably 180 to 230° C. The reaction can also be carried out at ordinary pressure or under reduced pressure or under pressurization. Usable as the catalyst are the same ones as those mentioned above for polyester production.

Specific examples of (B1-A-2) include, but are not limited to, the following oligomers:

(1) An ester oligomer from $C_8F_{17}COOH$ (30 mole percent), adipic acid (30 mole percent) and trimethylolpropane-PO (10 moles)-EO (10 moles) adduct (40 mole percent) (fluorine content=15% by weight, MW=12,600);

(2) An ester oligomer from trimellitic anhydride (24 mole percent), adipic acid (12 mole percent), $C_8F_{17}CH_2CH_2OH$ (29 mole percent) and hexylene glycol-PO (10 moles)-EO (12 moles) adduct (35 mole-percent) (fluorine-content=15% by weight, MW=10,500);

(3) An ester-amide oligomer from $C_8F_{17}COOH$ (28 mole percent), adipic acid (33 mole percent), trimethylolpropane-PO (10 moles)-EO (10 moles) adduct (28 mole percent) and octylamine (11 mole percent) (fluorine content=18% by weight, MW=9,200);

(4) An ester oligomer obtained by transesterification from a hydroxyl-containing Rf compound obtained by reacting adipic acid with the compound represented by the chemical formula (11) shown below in a mole ratio of 1:2 (17 mole percent), polypropylene glycol (MW=1700)-ethylene oxide (16 moles) adduct (10 mole percent), polyethylene glycol with MW=400 (23 mole percent) and dimethyl adipate (50 mole percent) (fluorine content=18% by weight, MW=13,500);

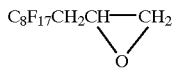

(11)

(5) An ester oligomer obtained by transesterification from trimethyl trimellitate (43 mole percent), $C_8F_{17}CH_2CH_2OH$ (31 mole percent), polypropylene glycol (MW=1700)-ethylene oxide (16 moles) adduct (19 mole percent) and polyethylene glycol with MW=400 (19 mole percent) (fluorine content=14% by weight, MW=12,500);

(6) An ester oligomer obtained by transesterification from $C_8F_{17}CH_2CH_2OH$ (43 mole percent), dimethyl adipate (43 mole percent) and trimethylolpropane—PO (68 moles)-EO (10 moles) block adduct (14 mole percent) (fluorine content=16% by weight, MW=6,200);

(7) An ester oligomer obtained by transesterification from a hydroxyl-containing Rf compound obtained by reacting 1,2-diglycidylethane with $C_8F_{17}CO_2H$ in a mole ratio of 1:2 (17 mole percent), polypropylene glycol (MW=1700)-ethylene oxide (16 moles) adduct (17 mole percent), polyethylene glycol with MW=400 (17 mole percent) and dimethyl adipate (49 mole percent) (fluorine content=15% by weight, MW=18,100);

(8) An esterification product from $C_8F_{17}CH_2CH_2CH{=}CHCH(COOH)CH_2COOH$ (37.5 mole percent), polypropylene glycol (MW=1700)-ethylene oxide (16 moles) adduct (50 mole percent) and $C_8F_{17}CH_2CH_2OH$ (12.5 mole percent) (fluorine content=11% by weight, MW=11,500);

(9) An ester oligomer obtained by transesterification from $C_8F_{17}CH(OH)CH_2OH$ (25 mole percent), polypropylene glycol (MW=1700)-ethylene oxide (16 moles) adduct (15 mole percent), polyethylene glycol with MW=400 (10 mole percent) and dimethyl adipate (50 mole percent) (fluorine content=14% by weight, MW=15,400);

(10) An ester oligomer obtained by transesterification from an ester compound (25 mole percent) obtained by reacting a glycidyl ether, obtained by reacting 2-ethylhexanol-PO (10 moles) adduct potassium salt with epichlorohydrin, with adipic acid in a mole ratio of 2:1, a hydroxyl-containing Rf compound (25 mole percent) obtained by reacting the compound represented by the chemical formula (11) given above with adipic acid in a mole ratio of 2:1 and dimethyl adipate (50 mole percent) (fluorine content=26% by weight, MW=17,500);

(11) An ester oligomer obtained by transesterification from a hydroxy-containing Rf compound (17 mole percent) obtained by reacting the compound represented by the chemical formula (12) given below with adipic acid in a mole ratio of 2:1, polypropylene glycol (MW=1700)-ethylene oxide (16 moles) adduct (10 mole percent), polyethylene glycol with MW=400 (23 mole percent) and dimethyl adipate (50 mole percent) (fluorine content=19% by weight, MW=16,700);

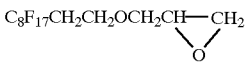

(12)

(12) An ester oligomer obtained by transesterification from an ester compound (16.7 mole percent) obtained by reacting a glycidyl ether, obtained by reacting butanol-PO (15 moles)-EO (10 moles) block adduct sodium salt or potassium salt with epichlorohydrin, with adipic acid in a mole ratio of 2:1, $C_8F_{17}CH(OH)CH_2OH$ (33.3 mole percent) and dimethyl adipate (50 mole percent) (fluorine content=15% by weight, MW=10,800).

As the oligomer or polymer (B1-A-3) resulting from polyaddition, there may be mentioned urethane type ones obtained by polyaddition from a mono- or polyhydric alcohol having an Rf group, if necessary together with another mono- or polyhydric alcohol, and a mono- or polyisocyanate.

Usable as the mono- or polyhydric alcohol having an Rf group and the other mono- or polyhydric alcohol are the same ones as mentioned hereinabove.

Usable as the mono- or polyisocyanate are those conventionally used in the production of polyurethanes. Thus, aromatic isocyanates, aliphatic isocyanates, alicyclic isocyanates and araliphatic polyisocyanates containing 4 to 20 carbon atoms (excluding the NCO carbon atom(s)).

As specific examples of the aromatic isocyanates, there may be mentioned phenyl isocyanate, 1,3- or 1,4-phenylene diisocyanate, 2,4- or 2,6-tolylene diisocyanate (TDI), crude TDI, 2,4'- or 4,4'-diphenylmethanediisocyanate (MDI), crude MDI, 1,5-naphthylene diisocyanate, 4,4',4"-triphenylmethanetriisocyanate, m- or p-isocyanatophenylsulfonyl isocyanate and the like.

As specific examples of the aliphatic isocyanates, there may be mentioned ethyl isocyanate, ethylene diisocyanate, tetramethylene diisocyanate, hexamethylene diisocyanate (HDI), dodecamethylene diisocyanate, 1,6,11-undecanetriisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl 2,6-diisocyanatohexanoate and the like.

As specific examples of the alicyclic isocyanates, there maybe mentioned cyclohexyl isocyanate, isophoronediisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornanediisocyanate and the like.

As specific examples of the araliphatic isocyanates, there may be mentioned benzyl isocyanate, m- or p-xylylene diisocyanate, α, α,α', α'-tetramethylxylylene diisocyanate and the like.

The ratio between the isocyanate and alcohol, when expressed in terms of hydroxyl equivalent/isocyanate equivalent ratio, is generally 0.6 to 1.6, preferably 0.7 to 1.5, more preferably 0.8 to 1.4.

The reaction temperature may be the same as generally employed in polyurethane formation reactions. Thus, it is generally 20 to 100° C. when a solvent is used and, when no solvent is used, it is generally 20 to 220° C., preferably 50 to 200° C.

For promoting the reaction, a catalyst generally used in polyurethane formation reactions (e.g. an amine catalyst such as triethylamine, N-ethylmorpholine and triethylenediamine; a tin catalyst such as trimethyltin laurate and dibutyltin dilaurate) may be used when necessary.

Specific examples of (B1-A-3) include, but are of course not limited to, the following oligomers:

(1) A urethane oligomer from $C_8F_{17}CH_2CH_2OH$ (27 mole percent), 4,4',4"-triphenylmethanetriisocyanate (27 mole percent), butanol-PO (20 moles)-EO (12 moles) adduct (27 mole percent) and polyethylene glycol (MW=600) (19 mole percent) (fluorine content=11% by weight, MW=9,000);

(2) A urethane oligomer from $C_8F_{17}CH_2CH_2OH$ (22 mole percent), 4,4'-diphenylmethanediisocyanate (MDI) (44 mole percent) and hexylene glycol-PO (10 moles)-EO (12 moles) adduct (34 mole percent) (fluorine content=12% by weight, MW=5,600);

(3) A urethane oligomer from a hydroxyl-containing Rf compound (25 mole percent) obtained by reacting adipic acid with the compound represented by the chemical formula (11) given above in a mole ratio of 1:2, isophoronediisocyanate (50 mole percent), polypropylene glycol (MW=1700)-ethylene oxide (16 moles) adduct (20 mole percent) and polyethylene glycol with MW=400 (5 mole percent) (fluorine content=18% by weight, MW=28,600);

(4) A urethane oligomer from $C_8F_{17}CH_2CH_2OH$ (43 mole percent), isophoronediisocyanate (43 mole percent) and trimethylolpropane-PO (68 moles)-EO (10 moles) block adduct (14 mole percent) (fluorine content=15% by weight, MW=6, 600);

(5) A urethane oligomer from $C_8F_{17}CH_2CH_2OH$ (40 mole percent), isophoronediisocyanate (40 mole percent) and a polyester diol (20 mole percent) with MW=11,600 as obtained by reacting polypropylene glycol (MW=1700)-ethylene oxide (16 moles) adduct with dimethyl adipate in a mole ratio of 7:6 (fluorine content=5% by weight, MW=24,300).

Usable as the ether oligomer or polymer (B1-A-4) resulting from ring opening polymerization are, among others, polymers having a structure resulting from ring opening addition polymerization of an epoxy compound and/or an epoxy compound having an Rf group with a mono- or polyhydric alcohol having an Rf group, and polymers having a structure resulting from ring opening addition polymerization of an epoxy compound having an Rf group, and if necessary an epoxy compound having no Rf group, with a mono- or polyhydric alcohol.

(B1-A-4) can be produced by ring opening addition polymerization of an epoxy compound and/or an epoxy compound having an Rf group with a mono- or polyhydric alcohol having an Rf group or by ring opening addition polymerization of an epoxy compound having an Rf group, and if necessary an epoxy compound having no Rf group, with a mono- or polyhydric alcohol.

Usable as the mono- or polyhydric alcohol (Rf-free alcohol) and the mono- or polyhydric alcohol having an Rf group are the same ones as mentioned hereinabove.

As the epoxy compound having an Rf group, there may be mentioned, among others, alkylene oxides containing 2 to 20 carbon atoms, such as tetrafluoroethylene oxide, hexafluoropropylene oxide, octafluorobutylene oxide and perfluorooctadecylene oxide, and fluorine compounds derived from these molecules by substitution of a hydrogen atom or atoms for part of the fluorine atoms (1 to 10 fluorine atoms) of these molecules as well as perfluoroalkyl-containing glycidyl ethers and fluorine compounds represented by the formula (13) given below (e.g. compounds represented by the above chemical formula (11):

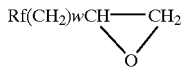

(13)

(w being 0 or an integer of 1 to 4).

As the epoxy compound (epoxy compound having no Rf group), there may be mentioned EO, PO, BO and glycidyl ethers (compound obtained by reacting a monohydric alcohol or an alkylene oxide adduct thereof with epichlorohydrin) and the like.

The addition of the epoxy compound to the alcohol can be carried out in the conventional manner, in one step or in multiple steps in the absence or presence of a catalyst (an alkali catalyst such as potassium hydroxide or sodium hydroxide; an amine catalyst such as triethylamine, N,N-dimethylpropylamine, N-methylpyrrolidine and benzyldimethylamine; an acid catalyst such as triphenylphosphine) at ordinary pressure and under pressurization. In cases where two or more epoxides are added, the mode of addition thereof may be random addition or block addition. The number of moles of the epoxide added is preferably 5 to 200.

Specific examples of (B1-A-4) include, but are of course not limited to, the following oligomers:

(1) A ring opening polymerization product from polypropylene glycol (MW=1,200) (1.4 mole percent), EO (52.8 mole percent), PO (41.7 mole percent) and the compound represented by the above chemical formula (11) (4.1 mole percent) (fluorine content 16% by weight, MW=6,000);

(2) A ring opening polymerization product from $C_8F_{17}CH_2CH_2OH$ (1.5 mole percent), EO (44.8 mole percent), PO (49.2 mole percent) and the compound represented by the above chemical formula (11) (4.5 mole percent) (fluorine content=25% by weight, MW=5,100);

(3) A ring opening polymerization product from an EO (8 moles)-PO (50 moles)-EO (8 moles) block adduct (14.3 mole percent) and the compound represented by the above chemical formula (12) (85.7 mole percent) (fluorine content=29% by weight, MW=6,700);

(4) A ring opening polymerization product from $C_8F_{17}CH_2CH_2OH$ (2.4 mole percent), EO (48.8 mole percent), PO (36.6 mole percent) and the compound represented by the above chemical formula (12) (12.2 mole percent) (fluorine content=34% by weight, MW=4,800).

The content of (B1-A) is not particularly restricted but, in view of the object of the invention, it is preferably 0.001 to 1.0% by weight, more preferably 0.004 to 0.8% by weight, based on the total weight of the spin finish after formulation.

Usable as the silicone oil (B1-B) are polydimethylsilicone oils having a kinematic viscosity at 25° C. of 5 to 1,000,000 cSt as well as amino-modified, polyalkylene glycol-modified, carboxylic acid-modified, epoxy-modified, carbinol-modified and/or alkyl (other than methyl)-modified or like modified silicone oils and the like.

The regulator (B1-C) is now described.

(B1-C) is an additive for controlling the kinematic viscosity of the oil after heating within a certain range by preventing thermal decomposition of (B1-A) and (B1-B) to thereby prevent the surface tension of the oil from increasing with the lapse of time and maintain the surface tension at a low level and by controlling the decomposition thereof (i.e. an agent for preventing the surface tension from increasing and an agent for controlling the kinematic viscosity) and preferably is a compound having, within the molecule thereof, a functional group having radical trapping ability.

As the functional group having radical trapping ability, there can be mentioned, among others, a hindered hydroxyphenyl group, an amino group, a hindered aminoalkyl group, a thioether group and a phosphate group, and compounds containing these functional groups within the molecule can be applied.

It is preferred that a total of 1 to 6, more preferably 2 to 4 radical trapping groups are present within each molecule.

(B1-C) preferably has a MW of 200 to 3,000, more preferably 400 to 2,000, as determined by GPC. When the MW is within this range, the compatibility with (A), (B1-A) and (B1-B) becomes still better. Further, two or more different radical-trapping functional groups may exist in the molecule or two or more (B1-C) species may be used.

Specific examples of (B1-C) include, but are not limited to, the following:

(1) Hindered Phenol Regulators:

Triethylene Glycol bis[3-(3-tert-butyl-5-methy-4-hydroxyphenyl)propionate, 1,6-hexanediol bis[3-(3,5-di-tert-butyl-4-hydroxyphenyl)propionate], pentaerythrityl tetrakis[3-(3,5-di-tert-butyl-4-hydroxyphenyl)propionate], octadecyl 3-(3,5-di-tert-butyl-4-hydroxyphenyl)propionate, 1,3,5-trimethyl-2,4,6-tris(3,5-di-tert-butyl-4-hydroxybenzyl)benzene, 2,4-di-tert-butylphenyl-3,5-di-tert-butyl-4-hydroxybenzoate, etc.;

(2) Amine and Hindered Amine Regulators:

Octylated Diphenylamine, 2-(5-methyl-2-hydroxyphenyl)benzotriazole, bis(2,2,6,6-tetramethyl-4-piperidyl) sebacate, etc.;

(3) Thioether Regulators:

Didodecyl 3,3'-thiodipropionate, bis[2-methyl-4-(3-dodecylthiopropionyloxy)-5-butylphenyl]sulfide, tetrakis[methylene-3-(dodecylthio) propionato]-methane, etc.;

(4) Phosphate Regulators:

4,4'-Isopropylidene-didodecylphenyl phosphite, tris (nonylphenyl) phosphite, diphenyl monodecyl phosphite, tris(2,4-di-tert-butylphenyl) phosphite, etc.; and (5) Regulators Containing two or more Different Functional Groups:

2,4-Bis(n-octylthio)-6-(4-hydroxy-3,5-di-tert-butylanilino)-1,3,5-triazine, 2,2-thiodiethylene bis[3-(3,6-di-tert-butyl-4-hydroxyphenyl)propionate, N,N'-hexamethylenebis (3,5-di-tert-butyl-4-hydroxyhydrocinnamide), diethyl 3,5-di-tert-butyl-4-hydroxybenzylphosphonate, bis(ethyl 3,5-di-tert-butyl-4-hydroxybenzylphosphonate) calcium, tris(3,5-di-tert-butyl-4-hydroxybenzyl) isocyanurate, 2,4-bis[(octylthio)methyl]-o-cresol, N,N'-bis[3-(3,5-di-tert-butyl-4-hydroxyphenyl)propionyl]hydrazine, bis(1,2,2,6,6-pentamethyl-4-piperidyl) 2-(3,5-di-tert-butyl-4-hydroxybenzyl)-2-n-butylmalonate, tridodecyl trithiophosphite, etc.

When (B1-C) is used, the amount of (B1-C) is not particularly restricted but, for the purpose of the invention, it is preferably 0.001 to 1% by weight, more preferably 0.004 to 0.8% by weight, based on the total weight of the spin finish, after compounding.

(B1) preferably comprises an Rf-containing compound (B1-A) and more preferably comprises (B1-A) and a regulator (B1-C).

(B) may contain a component (B2) other than (B1).

As (B2), there maybe mentioned emulsifiers generally used in conventional spin finishes (e.g. nonionic surfactants such as higher alcohol-EO adducts and higher fatty acid-EO adducts), antistatic agents (e.g. anionic, cationic, amphoteric surfactants, etc.) and the like.

When (B2) is used, the amount of (B2) is preferably 0.001 to 20% by weight, more preferably 0.005 to 15% by weight, still more preferably 0.01 to 12% by weight, based on the total weight of the spin finish.

In the spin finish for synthetic fibers according to the invention, any other arbitrary ingredient can be used unless it defeats the object of the invention.

The arbitrary ingredient includes, but is not particularly limited to, lubricants other than (A) (e.g. mineral oils, fatty acid ester oils, etc.), extreme pressure additives, rust inhibitors, antioxidants and other functional additives, among others.

When an arbitrary ingredient is used, the addition amount thereof is preferably 0.001 to 20% by weight based on the total weight of the spin finish.

The method of compounding (A) and (B) is not particularly restricted but any of those methods known in the art can be applied. For example, the method comprising charging predetermined amounts of (A) and (B) into a mixing vessel equipped with an agitating blade, followed by warming, stirring and homogenizing.

The present invention is further concerned with a method of treating thermoplastic synthetic fibers which comprises applying the spin finish mentioned above to thermoplastic synthetic fibers and subjecting the same to false twisting.

The spin finish for synthetic fibers as provided by the present invention is used as such or in the form of an aqueous solution or aqueous emulsion to lubricate yarns immediately after spinning in the step of melt spinning of thermoplastic synthetic fibers.

For use as an aqueous solution or aqueous emulsion, the oil concentration in the aqueous solution or aqueous emulsion can be selected arbitrarily within the range of 0.5 to 20% by weight, preferably 5.0 to 15.0% by weight, based on the weight of the aqueous solution or aqueous emulsion.

The method of feeding the spin finish is not particularly restricted but may comprise metering oiling through a nozzle, roller oiling or combination of these, for instance.

The oil pick-up of the spin finish is 00.1 to 1.5% by weight, preferably 0.2 to 0.6% by weight, as active ingredients (oil components other than water) on the basis of the fiber weight after winding up.

As the fiber to which the oil is applicable, there may be mentioned thermoplastic synthetic fibers such as polyester, polyamide and polypropylene fibers. The oil is particularly suited for use as a spin finish for polyester or nylon filaments to be submitted to false twisting.

The spin finish of the invention is suitably used in the process in which the thermoplastic fibers mentioned above are oiled in the spinning step and then subjected to false twisting. In particular, the oil is best suited for use for the so-called partially oriented yarn-draw textured yarn (POY-DTY), namely in draw false-twisting texturing (DTY) of partially oriented yarns (POY).

BEST MODES FOR CARRYING OUT THE INVENTION

The following examples further illustrate the invention. They are, however, by no means limitative of the scope of the invention. In the following, "part(s)" and "% " means "part(s) by weight" and "% by weight", respectively, unless otherwise specified.

EXAMPLES 1 to 48

Spin finishes 1 to 51 (Examples 1 to 51) according to the invention and spin finishes for comparison 1 to 14 (Comparative Examples 1 to 14) were prepared using a base oil, namely the polyether lubricant (A) specified below, and other components (B) in accordance with the formulations shown in Tables 1 to 5 and evaluated for the following items. The results are shown in Tables 1 to 5.

Surface tension after 1 hour of standing at 220° C. (mN/m);

Residue on heating after 24 hours of standing at 400° C. (%);

Ratio (V2/V1) between the kinematic viscosity (V1) of the spin finish at 25° C. after preparation and the viscosity (V2) thereof at 25° C. after 12 hours of standing at 220° C.

| <Base oil> | |
|---|---|
| Butanol-EO/PO random adduct (EO/PO = 50/50% by weight, MW = 1800) | 60 parts |
| Lauryl alcohol-PO-EO block adduct (EO/PO = 40/60% by weight, MW = 1400) | 20 parts |
| Propylene glycol-EO/PO random adduct (EO/PO = 50/50% by weight, MW = 6000) | 10 parts |
| Lauric acid-EO (10 moles) adduct | 10 parts |

<Other Components>

(B1-Aa)

An oligomer obtained by copolymerization of $C_8F_{17}C_2H_4OH$ acrylate (50 mole percent), polypropylene glycol (MW=1750)-EO (30 moles) adduct monoacylate (25 mole percent) and methyl methacrylate (25 mole percent) (fluorine content=15% by weight, MW=30,000);

(B1-Ab)

An oligomer obtained by copolymerization of $C_8F_{17}C_2H_4OH$ acrylate (40 mole percent), butanol-PO (20 moles)-EO (12 moles) adduct acrylate (40 mole percent) and methyl methacrylate (20 mole percent) (fluorine content=14% by weight, MW=18,600);

(B1-Ac)

An oligomer obtained by copolymerization of $C_8F_{17}SO_2N(C_3H_7)C_2H_4OH$-EO (5 moles) adduct acrylate (40 mole percent), methanol-EO (15 moles) adduct acrylate (30 mole percent) and methyl methacrylate (30 mole percent) (fluorine content=21% by weight, MW=12,000);

(B1-Ad)

A polymer obtained by copolymerization of $C_8F_{17}C_2H_4OH$ acrylate (50 mole percent), butanol-EO (20 moles)/PO (15 moles) random adduct acrylate (30 mole percent) and methyl methacrylate (20 mole percent) (fluorine content=18% by weight, MW=150,000);

(B1-Ae)

A polymer obtained by copolymerization of $C_8F_{17}C_2H_4OH$ fumaric acid diester (25 mole percent), butanol-EO (20 moles)/PO (20 moles) random adduct acrylate (40 mole percent) and methyl methacrylate (35 mole percent) (fluorine content=14% by weight, MW=26,700);

(B1-Af)

A polymer obtained by copolymerization of $C_8F_{17}C_2H_4OH$ acrylate (35 mole percent), butanol-EO (20 moles)/PO (15 moles) random adduct fumaric acid monoester (35 mole percent) and methyl methacrylate (30 mole percent) (fluorine content=13% by weight, MW=21, 300);

(B1-Ag)

An ester oligomer from $C_8F_{17}COOH$ (30 mole percent), adipic acid (30 mole percent) and trimethylolpropane-PO (10 moles)-EO (10 moles) adduct (40 mole percent) (fluorine content=15% by weight, MW=12,600);

(B1-Ah)

An ester oligomer from trimellitic anhydride (24 mole percent), adipic acid (12 mole percent), $C_8F_{17}CH_2CH_2OH$ (29 mole percent) and hexylene glycol-PO (10 moles)-EO (12 moles) adduct (35 mole percent) (fluorine content=15% by weight, MW=10,500);

(B1-Ai)

An ester amide oligomer from $C_8F_{17}COOH$ (28 mole percent), adipic acid (33 mole percent), trimethylolpropane-PO (10 moles)-EO (10 moles) adduct (28 mole percent) and octylamine (11 mole percent) (fluorine content=18% by weight, MW=9,200);

(B1-Aj)

An ester oligomer obtained by transesterification from a hydroxyl-containing Rf compound obtained by reacting adipic acid with the compound represented by the chemical formula (11) shown above in a mole ratio of 1:2 (17 mole percent), polypropylene glycol (MW=1700)-ethylene oxide (16 moles) adduct (10 mole percent), polyethylene glycol with MW=400 (23 mole percent) and dimethyl adipate (50 mole percent) (fluorine content 18% by weight, MW=13, 500);

(B1-Aki)

An ester oligomer obtained by transesterification from trimethyl trimellitate (43 mole percent), $C_8F_{17}CH_2CH_2OH$ (31 mole percent), polypropylene glycol (MW=1700)-ethylene oxide (16 moles) adduct (19 mole percent) and polyethylene glycol with MW=400 (19 mole percent) (fluorine content=14% by weight, MW=12,500);

(B1-Al)

An ester oligomer obtained by transesterification from $C_8F_{17}CH_2CH_2OH$ (43 mole percent), dimethyl adipate (43 mole percent) and trimethylolpropane-PO (68 moles)-EO (10 moles) block adduct (14 mole percent) (fluorine content=16% by weight, MW=6,200);

(B1-Am)

An ester oligomer obtained by transesterification from a hydroxyl-containing Rf compound obtained by reacting 1,2-diglycidylethane with $C_8F_{17}CO_2H$ in a mole ratio of 1:2 (17 mole percent), polypropylene glycol (MW=1700)-ethylene oxide (16 moles) adduct (17 mole percent), polyethylene glycol with MW=400 (17 mole percent) and dimethyl adipate (49 mole percent) (fluorine content=15% by weight, MW=18,100);

(B1-An)

An esterification product from $C_8F_{17}CH_2CH_2CH{=}CHCH(COOH)CH_2COOH$ (37.5 moles), polypropylene glycol (MW=1700)-ethylene oxide (16 moles) adduct (50 mole percent) and $C_8F_{17}CH_2CH_2OH$ (12.5 mole percent) (fluorine content=11% by weight, MW=11,500);

(B1-Ao)

An ester oligomer obtained by transesterification from $C_8F_{17}CH(OH)CH_2OH$ (25 mole percent), propylene glycol (MW=1700)-ethylene oxide (16 moles) adduct (15 mole percent), polyethylene glycol with MW=400 (10 mole percent) and dimethyl adipate (50 mole percent) (fluorine content=14% by weight, MW=15,400);

(B1-Ap)

An ester oligomer obtained by transesterification from an esterification product obtained by reacting a glycidyl ether, obtained by reacting 2-ethylhexanol-PO (10 moles) adduct potassium salt with epichlorohydrin, with adipic acid in a mole ratio of 2:1 (25 mole percent), a hydroxyl-containing Rf compound obtained by reacting the compound represented by the above chemical formula (11) with adipic acid in a mole ratio of 2:1 (25 mole percent) and dimethyl adipate (50 mole percent) (fluorine content=26% by weight, MW=17,500);

(B1-Aq)

An ester oligomer obtained by transesterification from a hydroxyl-containing Rf compound obtained by reacting the compound represented by the above chemical formula (12) with adipic acid in a mole ratio of 2:1 (17 mole percent), polypropylene glycol (MW=1700)-ethylene oxide (16 moles) adduct (10 mole percent), polyethylene glycol with MW=400 (23 mole percent) and dimethyl adipate (50 mole percent) (fluorine content=19% by weight, MW=16,700);

(B1-Ar)

An ester oligomer obtained by transesterification from an esterification product obtained by reacting a glycidyl ether, obtained by reacting butanol-PO (15 moles)-EO (10 moles) block adduct potassium salt with epichlorohydrin, with adipic acid in a mole ratio of 2:1 (16.7 mole percent), $C_8F_{17}CH(OH)CH_2OH$ (33.3 mole percent) and dimethyl adipate (50 mole percent) (fluorine content=15% by weight, MW=10,800);

(B1-As)

A urethane oligomer from $C_8F_{17}CH_2CH_2OH$ (27 mole percent), 4,4',4"-triphenylmethanetriisocyanate (27 mole percent), butanol-PO (20 moles)-EO (12 moles) adduct (27 mole percent) and polyethylene glycol (MW=600) (19 mole percent) (fluorine content=11% by weight, MW=9,000);

(B1-At)

A urethane oligomer from $C_8F_{17}CH_2CH_2OH$ (22 mole percent), 4,4'-diphenylmethanediisocyanate (MDI) (44 mole percent) and hexylene glycol-PO (10 moles)-EO (12 moles) adduct (34 mole percent) (fluorine content=12% by weight, MW=5,600);

(B1-Au)

A urethane oligomer from a hydroxyl-containing Rf compound obtained by reacting adipic acid with the compound represented by the above chemical formula (11) in a mole ratio of 1:2 (25 mole percent), isophoronediisocyanate (50 mole percent), polypropylene glycol (MW=1700)-ethylene oxide (16 moles) adduct (20 mole percent) and polyethylene glycol with MW=400 (5 mole percent) (fluorine content=18% by weight, MW=28,600);

(B1-Av)

A urethane oligomer from $C_8F_{17}CH_2CH_2OH$ (43 mole percent), isophoronediisocyanate (43 mole percent) and trimethylolpropane-PO (68 moles)-EO (10 moles) block adduct (14 mole percent) (fluorine content=15% by weight, MW=6, 600);

(B1-Aw)

A urethane oligomer from $C_8F_{17}CH_2CH_2OH$ (40 mole percent), isophoronediisocyanate (40 mole percent) and a polyester diol with MW=7,400 as obtained by reacting polypropylene glycol (MW=1700)-ethylene oxide (16 moles) adduct with dimethyl adipate in a mole ratio of 3:2 (20 mole percent) (fluorine content=7% by weight, MW=15,000);

(B1-Ax)

A ring opening polymerization product from polypropylene glycol (MW=1,200) (1.4 mole percent), EO (52.8 mole percent), PO (41.7 mole percent) and the compound represented by the above chemical formula (11) (4.1 mole percent) (fluorine content=16% by weight, MW=6,000);

(B1-Ay)

A ring opening polymerization product from $C_8F_{17}CH_2CH_2OH$ (1.5 mole percent), EO (44.8 mole percent), PO (49.2 mole percent) and the compound represented by the above chemical formula (11) (4.5 mole percent) (fluorine content=25% by weight, MW=5,100);

(B1-Az)

A ring opening polymerization product from EO (8 moles)-PO (50 moles)-EO (8 moles) block adduct (14.3 mole percent) and the compound represented by the above chemical formula (12) (85.7 mole percent) (fluorine content=29% by weight, MW=6,700);

(B1-Aaa)

A ring opening polymerization product from $C_8F_{17}CH_2CH_2OH$ (2.4 mole percent), EO (48.8 mole percent), PO (36.6 mole percent) and the compound represented by the above chemical formula (12) (12.2 mole percent) (fluorine content=34% by weight, MW=5,000);

(B1-Aab)

An oligomer obtained by copolymerization of $C_8F_{17}C_2H_4OH$ acrylate (35 mole percent), butanol-EO (15 moles) adduct acrylate (15 mole percent) and methyl methacrylate (50 mole percent) (fluorine content=31% by weight, MW=45,600);

(B1-Aac)

An oligomer obtained by copolymerization of $C_8F_{17}C_2H_4OH$ acrylate (65 mole percent) and butanol-PO (100 moles)-EO (50 moles) adduct acrylate (35 mole percent) (fluorine content=7% by weight, MW=18,000);

(B1-Aad)

An oligomer obtained by copolymerization of $C_8F_{17}C_2H_4OH$ acrylate (50 mole percent), butanol-PO (15 moles)-EO (20 moles) adduct acrylate (30 mole percent) and methyl methacrylate (20 mole percent) (fluorine content=18% by weight, MW=500,000).

(B1-Ca)

1,6-Hexanediol bis[3-(3,5-di-tert-butyl-4-hydroxyphenyl)propionate];

(B1-Cb)

Tris(3,5-di-tert-butyl-4-hydroxybenzyl) isocyanurate;

(B1-Cc)

Bis[2-methyl-4-(3-dodecylthiopropionyloxy)-5-butylphenyl] sulfide;

(B1-Cd)

Tris(2,4-di-tert-butylphenyl) phosphite.

(B2-a)

Alkanesulfonate Na salt containing 14 to 16 carbon atoms (MW=314);

(B2-b)

Isostearyl alcohol—EO (5 moles) adduct K salt (MW=872);

(B-2c)

Octyltrimethylammonium octylphosphate (MW=382);

(B-2d)

Triethylmethylammonium phthalate (MW=397).

(Comparative component a)

Potassium perfluorooctylsulfonate K salt (fluorine content=60% by weight, MW=538);

(Comparative Component b)

N-Perfluorooctylsulfonyl-N-aminopropylethanol-EO (10 moles) adduct (fluorine content=32% by weight, MW=1,025);

(Comparative Component c)

N-Perfluorooctylsulfonyl-N-aminopropylethanol-EO (20 moles) adduct (fluorine content=22% by weight, MW=1,465);

(Comparative Component d)

Polyalkylene glycol-modified polydimethylsiloxane (MW=15,000).

TABLE 1

| Ex. | 1 | 2 | 3 | 4 | 5 | 6 | 7 | 8 | 9 | 10 | 11 | 12 |
|---|---|---|---|---|---|---|---|---|---|---|---|---|
| Base oil | 100 | 100 | 100 | 100 | 100 | 100 | 100 | 100 | 100 | 100 | 100 | 100 |
| B1-Aa | 0.2 | 0.2 | — | — | — | — | — | — | — | — | — | — |
| B1-Ab | — | — | 0.2 | 0.2 | — | — | — | — | — | — | — | — |
| B1-Ac | — | — | — | — | 0.2 | 0.2 | — | — | — | — | — | — |
| B1-Ad | — | — | — | — | — | — | 0.2 | 0.8 | 0.8 | — | — | — |
| B1-Ae | — | — | — | — | — | — | — | — | — | 0.2 | — | — |
| B1-Af | — | — | — | — | — | — | — | — | — | — | 0.2 | 0.1 |
| B1-Ca | 0.2 | 0.5 | — | — | — | — | 0.5 | 0.5 | 0.5 | 0.2 | — | — |
| B1-Cb | — | — | 0.2 | 0.2 | — | — | — | — | — | — | 0.2 | — |
| B1-Cc | — | — | — | — | 0.2 | 0.2 | — | — | — | — | — | — |
| B1-Cd | — | — | — | — | — | — | — | — | — | — | — | — |
| B2-a | 0.3 | 0.3 | 0.3 | 0.8 | 0.3 | 0.7 | 0.3 | 0.3 | 0.8 | 0.3 | 0.3 | 0.3 |
| B2-b | 0.2 | 0.2 | 0.2 | 0.5 | 0.2 | 0.2 | 0.2 | 0.2 | 0.2 | 0.2 | 0.2 | 0.2 |
| (1) Surface tension (mN/m) | 13.8 | 13.2 | 14.0 | 14.1 | 14.3 | 14.4 | 14.5 | 13.2 | 14.2 | 13.9 | 14.1 | 21.5 |
| (2) Residue on heating (%) | 0.08 | 0.07 | 0.08 | 0.24 | 0.07 | 0.20 | 0.07 | 0.06 | 0.23 | 0.07 | 0.07 | 0.06 |
| (3) V2/V1 | 17 | 0.9 | 19 | 21 | 16 | 16 | 40 | 48 | 24 | 57 | 20 | 6 |

TABLE 2

| Ex. | 13 | 14 | 15 | 16 | 17 | 18 | 19 | 20 | 21 | 22 | 23 | 24 | 25 |
|---|---|---|---|---|---|---|---|---|---|---|---|---|---|
| Base oil | 100 | 100 | 100 | 100 | 100 | 100 | 100 | 100 | 100 | 100 | 100 | 100 | 100 |
| B1-Ag | 0.2 | — | — | — | — | — | — | — | — | — | — | — | — |
| B1-Ah | — | 0.2 | 0.2 | — | — | — | — | — | — | — | — | — | — |
| B1-Ai | — | — | — | 0.2 | — | — | — | — | — | — | — | — | — |
| B1-Aj | — | — | — | — | 0.2 | 0.2 | — | — | — | — | — | — | — |
| B1-Ak | — | — | — | — | — | — | 0.2 | — | — | — | — | — | — |
| B1-Al | — | — | — | — | — | — | — | 0.2 | — | — | — | — | — |
| B1-Am | — | — | — | — | — | — | — | — | 0.2 | — | — | — | — |
| B1-An | — | — | — | — | — | — | — | — | — | 0.2 | — | — | — |
| B1-Ao | — | — | — | — | — | — | — | — | — | — | 0.2 | — | — |
| B1-Ap | — | — | — | — | — | — | — | — | — | — | — | 0.2 | — |
| B1-Aq | — | — | — | — | — | — | — | — | — | — | — | — | 0.2 |
| B1-Ca | — | — | — | — | — | — | — | 0.2 | 0.1 | — | 0.1 | — | 0.2 |
| B1-Cb | — | 0.3 | 0.3 | — | — | — | 0.3 | — | — | 0.2 | — | — | — |
| B1-Cd | 0.2 | — | — | 0.2 | — | — | — | 0.2 | — | — | — | — | — |
| B2-a | 0.3 | 0.3 | 0.5 | 0.3 | 0.3 | 0.8 | 0.3 | 0.3 | 0.3 | 0.3 | 0.3 | 0.3 | 0.3 |
| B2-b | 0.2 | 0.2 | 0.2 | 0.2 | 0.2 | 0.5 | 0.2 | 0.2 | 0.2 | 0.2 | 0.2 | 0.2 | 0.2 |
| (1) Surface tension (mN/m) | 12.9 | 14.7 | 14.6 | 13.5 | 15.9 | 16.1 | 15.0 | 13.5 | 14.9 | 14.8 | 15.3 | 15.8 | 14.6 |
| (2) Residue on heating (%) | 0.06 | 0.11 | 0.18 | 0.09 | 0.07 | 0.22 | 0.10 | 0.07 | 0.08 | 0.07 | 0.07 | 0.07 | 0.08 |
| (3) V2/V1 | 36 | 22 | 23 | 41 | 33 | 37 | 23 | 5 | 8 | 6 | 18 | 20 | 21 |

TABLE 3

| Example | 26 | 27 | 28 | 29 | 30 | 31 | 32 | 33 | 34 | 35 | 36 | 37 | 38 |
|---|---|---|---|---|---|---|---|---|---|---|---|---|---|
| Base oil | 100 | 100 | 100 | 100 | 100 | 100 | 100 | 100 | 100 | 100 | 100 | 100 | 100 |
| B1-Ar | 0.2 | 0.1 | — | — | — | — | — | — | — | — | — | — | — |
| B1-As | — | — | 0.2 | — | — | — | — | — | — | — | — | — | — |
| B1-At | — | — | — | 0.2 | — | — | — | — | — | — | — | — | — |
| B1-Au | — | — | — | — | 0.2 | 0.2 | — | — | — | — | — | — | — |
| B1-Av | — | — | — | — | — | — | 0.2 | — | — | — | — | — | — |
| B1-Aw | — | — | — | — | — | — | — | 0.2 | 0.2 | — | — | — | — |
| B1-Ax | — | — | — | — | — | — | — | — | — | 0.2 | — | — | — |
| B1-Ay | — | — | — | — | — | — | — | — | — | — | 0.2 | — | — |
| B1-Az | — | — | — | — | — | — | — | — | — | — | — | 0.2 | — |
| B1-Aaa | — | — | — | — | — | — | — | — | — | — | — | — | 0.2 |
| B1-Ca | — | — | 0.05 | 0.2 | — | — | 0.3 | — | — | — | 0.1 | — | — |
| B1-Cb | 0.1 | — | — | — | — | — | — | — | — | 0.05 | — | 0.2 | — |
| B1-Cc | — | — | 0.05 | — | — | — | — | — | — | — | — | — | — |
| B1-Cd | — | — | — | — | — | — | — | — | — | 0.05 | — | — | — |
| B2-a | 0.3 | 0.8 | 0.3 | 0.3 | 0.3 | 0.8 | 0.3 | 0.3 | 0.6 | 0.3 | 0.3 | 0.3 | 0.3 |
| B2-b | 0.2 | 0.2 | 0.2 | 0.2 | 0.2 | 0.5 | 0.2 | 0.2 | 0.2 | 0.2 | 0.2 | 0.2 | 0.2 |
| (1) Surface tension (mN/m) | 15.0 | 21.3 | 13.8 | 14.2 | 15.9 | 16.0 | 14.6 | 18.9 | 19.9 | 14.2 | 14.9 | 15.1 | 15.4 |
| (2) Residue on heating (%) | 0.06 | 0.24 | 0.08 | 0.08 | 0.07 | 0.23 | 0.07 | 0.06 | 0.12 | 0.08 | 0.06 | 0.06 | 0.06 |
| (3) V2/V1 | 17 | 5 | 3 | 4 | 2 | 3 | 11 | 22 | 24 | 4 | 6 | 16 | 2 |

TABLE 4

| Example | 39 | 40 | 41 | 42 | 43 | 44 | 45 | 46 | 47 | 48 | 49 | 50 | 51 |
|---|---|---|---|---|---|---|---|---|---|---|---|---|---|
| Base oil | 100 | 100 | 100 | 100 | 100 | 100 | 100 | 100 | 100 | 100 | 100 | 100 | 100 |
| B1-Aa | 0.8 | 0.8 | 0.005 | — | — | — | — | — | — | — | — | — | — |
| B1-Ad | — | — | — | 0.1 | 0.1 | 0.1 | 0.1 | 0.1 | 0.1 | 0.1 | — | — | — |
| B1-Aab | — | — | — | — | — | — | — | — | — | — | 0.2 | — | — |
| B1-Aac | — | — | — | — | — | — | — | — | — | — | — | 0.2 | — |
| B1-Aad | — | — | — | — | — | — | — | — | — | — | — | — | 0.2 |
| Comparative Component a | — | — | — | 0.1 | — | — | — | — | — | — | — | — | — |
| Comparative component b | — | — | — | — | 0.1 | — | — | — | — | — | — | — | — |
| Comparative component c | — | — | — | — | — | 0.1 | — | — | — | — | — | — | — |
| Comparative component d | — | — | — | — | — | — | 0.1 | 0.2 | — | — | — | — | — |
| B1-Ca | 0.8 | 0.8 | 0.005 | 0.3 | 0.3 | — | — | — | — | — | — | — | — |
| B1-Cb | — | — | — | — | — | 0.2 | 0.2 | 0.2 | 0.2 | 0.2 | 0.2 | 0.2 | 0.2 |
| B2-a | 0.3 | 0.8 | 0.3 | 0.1 | 0.1 | 0.1 | 0.1 | 0.1 | 0.1 | 0.1 | 0.3 | 0.3 | 0.3 |
| B2-b | 0.2 | 0.2 | 0.2 | 0.1 | 0.1 | 0.1 | 0.1 | 0.1 | 0.1 | 0.1 | 0.2 | 0.2 | 0.2 |

TABLE 4-continued

| Example | 39 | 40 | 41 | 42 | 43 | 44 | 45 | 46 | 47 | 48 | 49 | 50 | 51 |
|---|---|---|---|---|---|---|---|---|---|---|---|---|---|
| B2-c | — | — | — | — | — | — | — | — | 0.1 | — | — | — | — |
| B2-d | — | — | — | — | — | — | — | — | — | 0.1 | — | — | — |
| (1) Surface tension (mN/m) | 12.2 | 12.4 | 14.9 | 13.3 | 14.0 | 14.1 | 14.3 | 14.0 | 14.8 | 14.5 | 13.9 | 14.5 | 14.5 |
| (2) Residue on heating (%) | 0.08 | 0.24 | 0.05 | 0.08 | 0.07 | 0.06 | 0.08 | 0.16 | 0.12 | 0.07 | 0.07 | 0.08 | 0.08 |
| (3) V2/V1 | 46 | 47 | 0.9 | 25 | 21 | 21 | 18 | 22 | 8 | 12 | 10 | 8 | 34 |

TABLE 5

| Compar. Ex. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Base oil | 100 | 100 | 100 | 100 | 100 | 100 | 100 | 100 | 100 | 100 | 100 | 100 | 100 | 100 |
| Comparative component a | 2 | 1 | 0.5 | — | — | — | — | — | — | — | — | — | — | — |
| Comparative component b | — | — | — | 1 | 0.1 | — | — | — | — | — | — | — | — | — |
| Comparative comparative c | — | — | — | — | — | 1 | 0.1 | — | — | — | 0.1 | — | — | — |
| Comparative component d | — | — | — | — | — | — | — | 5 | 0.1 | — | 0.1 | 5 | 0.1 | — |
| B2-a | 0.3 | 0.3 | 0.3 | 0.3 | 0.3 | 0.3 | 0.3 | 0.3 | 0.3 | 0.3 | — | — | 0.3 | — |
| B2-b | 0.2 | 0.2 | 0.2 | 0.2 | 0.2 | 0.2 | 0.2 | 0.2 | 0.2 | 0.2 | 0.2 | 0.5 | — | 0.2 |
| B2-c | — | — | — | — | — | — | — | — | — | — | 0.3 | — | 0.1 | — |
| B2-d | — | — | — | — | — | — | — | — | — | — | — | 0.2 | — | 0.2 |
| B1-Ba | 0.2 | 0.2 | 0.2 | — | — | 0.1 | 0.1 | — | — | 0.1 | — | — | — | — |
| B1-Bb | — | — | — | 0.1 | 0.1 | — | — | 0.05 | 0.05 | — | — | — | — | — |
| B1-Bc | — | — | — | — | — | — | — | — | — | — | — | 0.1 | — | 0.05 |
| B1-Bd | — | — | — | — | — | — | — | — | — | — | — | — | 0.1 | — |
| (1) Surface tension (mN/m) | 23.0 | 24.0 | 24.8 | 23.1 | 24.5 | 22.8 | 23.0 | 19.9 | 22.4 | 26.8 | 23.2 | 20.5 | 22.1 | 27.8 |
| (2) Residue on heating (%) | 1.80 | 1.01 | 0.66 | 0.18 | 0.18 | 0.17 | 0.20 | 4.78 | 0.45 | 0.09 | 0.30 | 4.52 | 0.44 | 0.09 |
| (3) V2/V1 | 0.4 | 0.5 | 0.7 | 21 | 12 | 1 | 10 | 65 | 32 | 50 | 0.9 | 68 | 10 | 72 |

From Tables 1 to 5, it is evident that the oils of the invention are lower in surface tension after 1 hour of standing at 220° C. and lower in percent residue upon 24 hours of heating at 400° C. as compared with the comparative oils. It is also evident that the kinematic viscosity before and that after 12 hours of heating at 220° C. are controlled within a specific range.

USE EXAMPLES AND COMPARATIVE EXAMPLES

A polyester was melt spinning and a 230-denier/36-filament POY was reeled at a winding speed of 3,200 m/min. In this step, each of the spin finishes 1 to 51 of the invention and the comparative spin finishes 1 to 14 was fed, in the form of a 10 weight % emulsion, through a nozzle so that the oil pick-up of active ingredient amounted to be 0.3%. The POYs thus obtained were subjected to draw false-twist texturing by the three axle circumscribing friction technique using polyurethane disks at a hot plate temperature of 220° C. and at a texturing speed of 800 m/min. After the lapse of one month from the start of texturing, the state of tar formation on the hot plate was examined (evaluation by the eye; ◎—almost none; ○—slight formation partly on the yarn guide; Δ—some tar formation partly on and around the yarn guide; X —significant formation partly on and around the yarn guide; X X —significant formation on and around the yarn guide), while the frequency of yarn breaking (the numerical value calculated as the number of yarn breakings per 100 textured yarn cheeses by counting yarn breakings over a period during which 1,000 4-kg textured yarn cheeses were obtained) was examined. The evaluation results thus obtained are shown in Tables 6 to 8.

Further, a polyester was melt spinning and a 270-denier/36-filament POY was reeled at a winding speed of 2,700 m/min. In this step, each of the spin finishes 1 to 51 of the invention and the comparative spin finishes 1 to 14 was fed, in the form of a 10 weight % emulsion, through a nozzle so that the oil pick-up of active ingredient amounted to 0.3%. The POYs thus obtained were subjected to draw false-twist texturing by the three axle circumscribing friction technique using polyurethane disks at a radiation type high temperature heater temperatures of 500° C. (upper level) and 450° C. (lower level) and at a texturing speed of 1,100 m/min. After the lapse of 3 months from the start of texturing, the amount of scum adhering to the guide within the heater was examined (evaluation by the eye; ◎—almost none; ○—slight; Δ—some; X—significant), while the frequency of yarn breaking was examined. The evaluation results thus obtained are shown in Tables 6 to 8.

TABLE 6

| | | |
|---|---|---|
| Reeling speed | 3200 m/min | 2700 m/min |
| Denier | 230 | 270 |
| DTY temperature | 220° C. | 500° C. (upper level)<br>450° C. (lower level) |
| Texturing speed | 800 m/min | 1100 m/min |

TABLE 6-continued

| Use Example | 1 month after start: Tar on hot plate | 1 month after start: Yarn breaking (%) | 3 months after start: Scum adhesion within heater | 3 months after start: Yarn breaking (%) |
|---|---|---|---|---|
| 1 | ◎ | 0.1 | ◎ | 0.1 |
| 2 | ◎ | 0.1 | ◎ | 0.1 |
| 3 | ◎ | 0.1 | ◎ | 0.2 |
| 4 | ○ | 0.5 | ○ | 0.4 |
| 5 | ◎ | 0.2 | ◎ | 0.2 |
| 6 | ○ | 0.6 | ◎ | 0.2 |
| 7 | ◎ | 0.2 | ◎ | 0.1 |
| 8 | ◎ | 0.2 | ◎ | 0.1 |
| 9 | ○ | 0.6 | ○ | 0.4 |
| 10 | ◎ | 0.1 | ◎ | 0.1 |
| 11 | ◎ | 0.2 | ◎ | 0.2 |
| 12 | ○ | 0.8 | ◎ | 0.1 |
| 13 | ○ | 0.4 | ◎ | 0.3 |
| 14 | ○ | 0.4 | ◎ | 0.3 |
| 15 | ○ | 0.2 | ◎ | 0.1 |
| 16 | ○ | 0.5 | ◎ | 0.2 |
| 17 | ◎ | 0.2 | ◎ | 0.1 |
| 18 | ○ | 0.6 | ○ | 0.5 |
| 19 | ○ | 0.4 | ◎ | 0.3 |
| 20 | ○ | 0.3 | ◎ | 0.2 |
| 21 | ◎ | 0.3 | ◎ | 0.2 |
| 22 | ○ | 0.4 | ◎ | 0.3 |
| 23 | ○ | 0.4 | ◎ | 0.2 |
| 24 | ◎ | 0.2 | ◎ | 0.1 |
| 25 | ◎ | 0.3 | ◎ | 0.2 |
| 26 | Δ | 0.8 | ◎ | 0.3 |

TABLE 7

| Reeling speed / Denier / DTY temperature / Texturing speed | 3200 m/min / 230 / 220° C. / 800 m/min | | 2700 m/min / 270 / 500° C. (upper level) / 450° C. (lower level) / 1100 m/min | |
|---|---|---|---|---|
| | 1 month after start | | 3 months after start | |
| Use Example | Tar on hot plate | Yarn breaking (%) | Scum adhesion within heater | Yarn breaking (%) |
| 27 | Δ | 1.0 | ○ | 0.4 |
| 28 | ○ | 0.4 | ◎ | 0.3 |
| 29 | ○ | 0.5 | ◎ | 0.3 |
| 30 | ◎ | 0.2 | ◎ | 0.1 |
| 31 | ○ | 0.7 | ○ | 0.5 |
| 32 | ○ | 0.4 | ◎ | 0.3 |
| 33 | Δ | 0.9 | ◎ | 0.5 |
| 34 | Δ | 1.0 | ◎ | 0.2 |
| 35 | ◎ | 0.4 | ◎ | 0.3 |
| 36 | ◎ | 0.3 | ◎ | 0.4 |
| 37 | ◎ | 0.5 | ◎ | 0.4 |
| 38 | ◎ | 0.4 | ◎ | 0.3 |
| 39 | ◎ | 0.1 | ◎ | 0.2 |
| 40 | ◎ | 0.1 | ○ | 0.5 |
| 41 | ○ | 0.4 | ◎ | 0.4 |
| 42 | ◎ | 0.2 | ◎ | 0.2 |
| 43 | ◎ | 0.2 | ◎ | 0.1 |
| 44 | ◎ | 0.2 | ◎ | 0.1 |
| 45 | ◎ | 0.3 | ◎ | 0.2 |
| 46 | ◎ | 0.2 | ◎ | 0.3 |
| 47 | ◎ | 0.3 | ◎ | 0.3 |
| 48 | ◎ | 0.3 | ◎ | 0.2 |
| 49 | ◎ | 0.3 | ◎ | 0.2 |
| 50 | ◎ | 0.4 | ◎ | 0.3 |
| 51 | ◎ | 0.3 | ◎ | 0.2 |

TABLE 8

| Reeling speed / Denier / DTY temperature / Texturing speed | 3200 m/min / 230 / 220° C. / 800 m/min | | 2700 m/min / 270 / 500° C. (upper level) / 450° C. (lower level) / 1100 m/min | |
|---|---|---|---|---|
| | 1 month after start | | 3 months after start | |
| Use Example | Tar on hot plate | Yarn breaking (%) | Scum adhesion within heater | Yarn breaking (%) |
| 1 | Δ | 2.1 | Δ | 3.1 |
| 2 | Δ | 2.9 | Δ | 3.0 |
| 3 | Δ~X | 3.4 | Δ | 3.6 |
| 4 | Δ~X | 4.3 | Δ | 3.4 |
| 5 | X | 4.8 | ○ | 3.7 |
| 6 | Δ~X | 4.2 | Δ | 3.3 |
| 7 | X | 4.9 | ○ | 3.8 |
| 8 | Δ | 2.2 | X | ≧5 |
| 9 | X | 2.9 | Δ | 4.4 |
| 10 | XX | ≧5 | ○ | 3.3 |
| 11 | X | 3.0 | Δ | 3.8 |
| 12 | Δ | 2.4 | X | ≧5 |
| 13 | X | 2.8 | Δ | 4.4 |
| 14 | XX | ≧5 | ○ | 3.3 |

From Tables 6 to 8, it is evident that the spin finishes of the invention show excellent spinning effects in false twisting by the hot plate contact heating method as well as in false twisting by means of a radiation type high temperature heater and make it possible to operate stably for a long period of time with a reduced frequency of yarn breaking.

INDUSTRIAL APPLICABILITY

The use of the spin finish for synthetic fibers according to the invention makes it possible to produce POYs stably for a very long period of time in false twisting by the conventional hot plate contact heating method as well as in false twisting by the conventional non-contact heating method using a radiation type high temperature heater, and markedly prolong the heater cleaning cycle.

Therefore, from the viewpoint of productivity and operability, the oil is very useful as a spin finish for thermoplastic synthetic fibers to be submitted to false twisting.

What is claimed is:

1. A spin finish for synthetic fibers which satisfies the following relations (1) and (2):

$$10 \leqq T \leqq 22 \quad (1)$$

$$0 \leqq Re \leqq 0.25 \quad (2)$$

where T is the surface tension (mN/m) of the finish after allowing the same to stand at 220° C. for 1 hour and Re is the percent residue (% by weight) on heating of the finish after allowing the same to stand at 400° C. for 24 hours, and which comprises a polyether lubricant (A) and another component (B), said component (B) comprising a constituent (B 1) causing the spin finish after mixing up to show a surface tension of not higher than 22 mN/m after 1 hour of standing at 220° C.

2. The spin finish according to claim 1, wherein T and Re satisfy the relations (3) and (4), respectively:

$$10 \leqq T \leqq 20 \quad (3)$$

$$0 \leqq Re \leqq 0.20 \quad (4).$$

3. The spin finish according to claim 2, wherein T and Re satisfy the relations (5) and (6), respectively;

$$10 \leqq T \leqq 15 \quad (5)$$

$$0 \leqq Re \leqq 0.15 \quad (6).$$

4. The spin finish according to claim 1, which satisfies the following relation (7):

$$0.5 \leqq V2/V1 \leqq 60 \quad (7)$$

where V2 is the kinematic viscosity ($mm^2/s$) of the finish at 25° C. after allowing the same to stand at 220° C. for 12 hours V1 is the kinematic viscosity ($mm^2/s$) of the finish at 25° C. before standing.

5. The spin finish according to claim 4, wherein V1 and V2 satisfy the relation (8):

$$0.8 \leqq V2/V1 \leqq 50 \quad (8).$$

6. The spin finish according to claim 1, wherein (B1) comprises a perfluoroalkyl- and/or perfluoroalkylene-containing compound (B1-A).

7. The spin finish according to claim 6, wherein the fluorine content of (B1-A) is 5 to 40% by weight based on the weight of (B1-A).

8. The spin finish according to claim 6, wherein (B1-A) has a polyoxyalkylene chain.

9. The spin finish according to claim 8, wherein the weight proportion of the polyoxyalkylene chain moiety in (B1-A) is 30 to 90% by weight based on the weight of (B1-A).

10. The spin finish according to claim 6, wherein (B1-A) has the perfluoroalkyl and/or perfluoroalkylene group on a side chain thereof.

11. The spin finish according to claim 6, wherein (B1-A) is an oligomer or polymer obtained by subjecting a perfluoroalkyl- and/or perfluoroalkylene-containing monomer to polymerization, the mode of polymerization being selected from the group consisting of vinyl addition polymerization (B1-A-1), polycondensation (B1-A-2), polyaddition (B1-A-3) and ring opening polymerization (B1-A-4).

12. The spin finish according to claim 11, wherein (B1-A-1) is a vinyl oligomer or vinyl polymer comprising a perfluoroalkyl-containing vinyl monomer (b1) and a vinyl monomer (b2) having a polyoxyalkylene chain as essential constituent units.

13. The spin finish according to claim 12, wherein (b1) is a (co)polymerizable unsaturated monomer represented by the general formula (9):

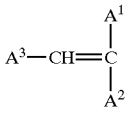

(9)

wherein $A^1$ represents a group of the formula Rf—X—$(OE^1)_m$—Q—$(CH_2)_n$— (hereinafter referred to as G—for short), a group of the formula G—$OCH_2$—$(CHOH)_{4-p}$ $(CHO—G)_p$—Q—$(CH_2)_n$—or a group of the formula —$C_6H_{5-q}$(—O—G)$_q$;

$A^2$ and $A^3$ are the same or different and each represents a hydrogen atom, a methyl group or a group of the formula Rf—X—$(OE^1)_m$—Q—$(CH_2)_n$— or of the formula $R^3$—X—$(OE^1)_m$—Q—$(CH_2)_n$—; and in the above definitions, Rf represents a perfluoroalkyl group containing 3 to 18 carbon atoms;

X represents a group of the formula —(CH2)r—, a group of the formula —SO2NR1—E2— or a group of the formula —CONR2—E2— (in which r represents 0 or an integer of 1 to 4, R1 and R2 are the same or different and each represents a hydrogen atom or an alkyl group containing 1 to 8 carbon atoms and E2 represents an alkylene group containing 1 to 8 carbon atoms);

E1 represents an alkylene group containing 2 to 4 carbon atoms;

m represents an 0 or integer of 1 to 20;

Q represents a group of the formula —OCO—, a group of the formula —O— or a group of the formula —NHCO—;

n represents 0 or an integer of 1;

p represents 0 or an integer of 1 to 4;

q represents an integer of 1 to 5; and

R3 represents an alkyl or acyl group containing 1 to 12 carbon atoms.

14. The spin finish according to claim 12, wherein (b2) is a (co)polymerizable unsaturated monomer represented by the general formula (10):

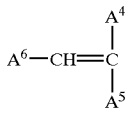

(10)

wherein $A^4$ represents a group of the formula $R^4$—$(OE^3)_s$—Z—$(CH_2)_t$— (hereinafter referred to as J—for short), a group of the formula J—$OCH_2$—$(CHOH)_{4-p}$ $(CHO—J)_p$—Z—$(CH_2)_t$— or a group of the formula —$C_6H_{5-q}$(O—J)$_q$;

$A^5$ and $A^6$ are the same or different and each represents a hydrogen atom, a methyl group or J—; and in the above definitions, $R^4$ represents a hydrogen atom or an alkyl or acyl group containing 1 to 12 carbon atoms;

$E^3$ represents an alkylene group containing 2 to 4 carbon atoms;

s represents an integer of 1 to 200;

Z represents a group of the formula —OCO—, a group of the formula —O— or a group of the formula —NHCO—;

t represents 0 or an integer of 1 to 12;

p represents 0 or an integer of 1 to 4; and q represents an integer of 1 to 5.

15. The spin finish according to claim 14, wherein, referring to the general formula (10), s is an integer of 2 to 200 and the polyoxyalkylene chain —$(OE^3)_s$— comprises a combination of oxyethylene and oxypropylene groups.

16. The spin finish according to claim 12, wherein (B1-A-1) is a product of polymerization of (b1), (b2) and another vinyl monomer (b3), with (b1) accounting for 10 to 70 mole percent, (b2) for 10 to 50 mole percent and (b3) for 10 to 70 mole percent, based on the total number of moles of (b1), (b2) and (b3).

17. The spin finish according to claim 6, wherein the content of (B1-A) is 0.001 to 1.0% by weight based on the total weight of the spin finish.

18. The spin finish according to claim 1, which further comprises at least one regulator (B1-C) selected from the group consisting of hindered phenol regulators, amine and hindered amine regulators, thioether regulators, phosphate regulators and regulators containing two or more different functional groups.

19. The spin finish according to claim 18, wherein the regulator containing two or more different functional groups is selected from the group consisting of 2,4-Bis(n-octylthio)-6-(4-hydroxy-3,5-di-tert-butylanilino)-1,3,5-triazine,2,2-thiodiethylene bis [3-(3,6-di-tert-butyl-4-hydroxyphenyl)propionate, N,N'-hexamethylenebis(3,5-di-tert-butyl-4-hydroxyhydrocinnamide), diethyl 3,5-di-tert-butyl-4-hydroxybenzylphosphonate, bis(ethyl 3,5-di-tert-butyl-4-hydroxybenzylphosphonate) calcium, tris (3,5-di-tert-butyl-4-hydroxybenzyl) isocyanurate, 2,4-bix [(octylthio)methyl]-o-cresol,N,N'-bis[3-(3,5-di-tert-butyl-4-hydroxyphenyl)propionyl]hydrazine,bis (1,2,2,6,6-pentamethyl-4-piperidyl) 2-(3,5-di-tert-butyl-4-hydroxybenzyl)-2-n-butylmalonate and triodecyl trithiophosphite.

20. The spin finish according to claim 1, which is used in draw false-twisting texturing of partially oriented yarns.

21. A method of treating a thermoplastic synthetic fiber which comprises carrying out false twisting while applying the spin finish according to claim 1 to a thermoplastic synthetic fiber.

* * * * *